US009859663B2

(12) United States Patent
Sparrowhawk et al.

(10) Patent No.: US 9,859,663 B2
(45) Date of Patent: Jan. 2, 2018

(54) COMMUNICATIONS CONNECTOR SYSTEM

(71) Applicant: Leviton Manufacturing Co., Inc., Melville, NY (US)

(72) Inventors: Bryan L. Sparrowhawk, Monroe, WA (US); Bret Taylor, Seattle, WA (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 15/052,630

(22) Filed: Feb. 24, 2016

(65) Prior Publication Data

US 2016/0172794 A1 Jun. 16, 2016

Related U.S. Application Data

(63) Continuation of application No. 14/211,624, filed on Mar. 14, 2014, now Pat. No. 9,343,822.
(Continued)

(51) Int. Cl.
*H01R 13/6593* (2011.01)
*H01R 13/6471* (2011.01)
(Continued)

(52) U.S. Cl.
CPC ..... *H01R 13/6593* (2013.01); *H01R 4/24* (2013.01); *H01R 4/2416* (2013.01);
(Continued)

(58) Field of Classification Search
CPC ..... H01R 13/6471; H01R 13/648; H01R 13/65807; H01R 13/6585; H01R 13/6593;
(Continued)

(56) References Cited

U.S. PATENT DOCUMENTS 3,636,500 A 1/1972 Sedlacek
3,763,461 A 10/1973 Kotski
(Continued)

FOREIGN PATENT DOCUMENTS

CN 101142757 3/2008
EP 1 443 608 8/2004
(Continued)

OTHER PUBLICATIONS

English Abstract of Japanese Patent Publication No. 2006-318801, published Nov. 24, 2006.
(Continued)

*Primary Examiner* — James Harvey
*Assistant Examiner* — Matthew T Dzierzynski
(74) *Attorney, Agent, or Firm* — Davis Wright Tremaine LLP; George C. Rondeau, Jr.; Heather M. Colburn

(57) ABSTRACT

Shields, wire connectors, crimping devices, and wire managers. At least some of the shields are used with a cable that includes a jacket surrounding wire pairs, and a different pair shield surrounding each wire pair. Such shields include a compressible member positioned adjacent end portions of a portion of the wire pairs. The compressible member presses a conductive member against the pair shield surrounding each wire pair in the portion of wire pairs. At least some of the wire connectors include a conductive body positionable alongside a selected wire having a connector surrounded circumferentially by an insulating jacket. The body includes a receptacle with a tapered opening defined between first and second edge portions of the body. As a portion of the selected wire passes through the opening into the receptacle, the first and second edge portions cut through the insulating jacket to contact the conductor.

15 Claims, 29 Drawing Sheets

Related U.S. Application Data

(60) Provisional application No. 61/789,271, filed on Mar. 15, 2013.

(51) Int. Cl.

| | |
|---|---|
| ***H01R 4/24*** | (2006.01) |
| ***H01R 13/6585*** | (2011.01) |
| *H01B 11/06* | (2006.01) |
| *H01B 11/08* | (2006.01) |
| *H01B 11/04* | (2006.01) |
| *H01B 7/30* | (2006.01) |
| *H01R 13/648* | (2006.01) |
| *H01R 13/658* | (2011.01) |

(52) U.S. Cl.
CPC ..... *H01R 4/2437* (2013.01); *H01R 4/2441* (2013.01); *H01R 4/2466* (2013.01); *H01R 13/6471* (2013.01); *H01R 13/6585* (2013.01); *H01B 11/06* (2013.01); *H01R 13/648* (2013.01); *H01R 13/65807* (2013.01)

(58) Field of Classification Search
CPC ..... H01B 11/06; H01B 11/08; H01B 11/04; H01B 11/00; H01B 7/30
USPC ... 174/74 R, 76, 77 R, 80, 74 A, 84 R, 88 R, 174/93
See application file for complete search history.

(56) References Cited

U.S. PATENT DOCUMENTS

| | | | | |
|---|---|---|---|---|
| 3,845,455 | A | 10/1974 | Shoemaker | |
| 3,975,076 | A | 8/1976 | Shida et al. | |
| 4,682,835 | A | 7/1987 | Aujla et al. | |
| 4,749,366 | A | 6/1988 | McCaffery | |
| 4,847,711 | A | 7/1989 | Inoue | |
| 4,870,227 | A | 9/1989 | Saen et al. | |
| 4,897,040 | A | 1/1990 | Gerke et al. | |
| 4,909,754 | A | 3/1990 | Paradis | |
| 4,973,258 | A | 11/1990 | Fusselman | |
| 4,973,261 | A | 11/1990 | Hatagishi | |
| 5,131,863 | A | 7/1992 | Gerke et al. | |
| 5,230,632 | A | 7/1993 | Baumberger et al. | |
| 5,281,176 | A | 1/1994 | Yahagi et al. | |
| 5,501,607 | A | 3/1996 | Yoshioka et al. | |
| 5,533,910 | A | 7/1996 | Korner et al. | |
| 5,547,405 | A | 8/1996 | Pinney | |
| 5,836,782 | A | 11/1998 | Odley et al. | |
| 5,848,911 | A | 12/1998 | Garcin | |
| 6,142,817 | A | 11/2000 | Lee | |
| 6,371,793 | B1 | 4/2002 | Doorhy et al. | |
| 6,379,157 | B1 | 4/2002 | Curry et al. | |
| 6,431,903 | B1 | 8/2002 | Dittmann et al. | |
| 6,595,696 | B1 | 7/2003 | Zallak | |
| 6,764,222 | B1 | 7/2004 | Szilagyi et al. | |
| 6,786,776 | B2 | 9/2004 | Itano et al. | |
| 6,796,806 | B2 | 9/2004 | Boutros et al. | |
| 6,957,970 | B2 | 10/2005 | Weigel et al. | |
| 7,077,670 | B2 | 7/2006 | Suwa et al. | |
| 7,086,909 | B2 | 8/2006 | Colantuono et al. | |
| 7,220,149 | B2 * | 5/2007 | Pharney | H01R 13/6467 439/676 |
| 7,249,974 | B2 | 7/2007 | Gordon et al. | |
| D565,443 | S | 4/2008 | Frake | |
| 7,413,464 | B1 | 8/2008 | Chen | |
| D587,201 | S | 2/2009 | Allwood | |
| 7,597,568 | B1 | 10/2009 | Lu | |
| D603,341 | S | 11/2009 | Kawakami | |
| 7,686,642 | B2 | 3/2010 | Pearson et al. | |
| 7,704,093 | B2 | 4/2010 | Turkekole et al. | |
| 7,713,094 | B1 | 5/2010 | Sparrowhawk | |
| 7,736,173 | B2 | 6/2010 | Chen | |
| 7,736,195 | B1 | 6/2010 | Poulsen et al. | |
| RE41,699 | E | 9/2010 | Itano et al. | |
| 7,821,370 | B1 | 10/2010 | Shu et al. | |
| 7,824,231 | B2 | 11/2010 | Marti et al. | |
| 7,857,655 | B2 | 12/2010 | Gyagang et al. | |
| 7,909,656 | B1 * | 3/2011 | Erickson | H01R 13/6463 439/676 |
| 7,967,645 | B2 | 6/2011 | Marti et al. | |
| 7,976,334 | B2 | 7/2011 | Bishop | |
| 8,038,482 | B2 | 10/2011 | Erickson et al. | |
| D649,971 | S | 12/2011 | Lyford | |
| 8,100,705 | B2 | 1/2012 | Chen et al. | |
| 8,128,436 | B2 | 3/2012 | Bopp et al. | |
| 8,137,141 | B2 | 3/2012 | Straka et al. | |
| 8,198,536 | B2 * | 6/2012 | Clark | H01B 11/04 174/113 C |
| D663,273 | S | 7/2012 | Lyford | |
| D668,226 | S | 10/2012 | Lyford | |
| 8,475,201 | B2 | 7/2013 | Pirlo | |
| 8,690,459 | B2 | 4/2014 | Lin et al. | |
| D714,293 | S | 9/2014 | Kelly | |
| D721,036 | S | 1/2015 | Kreitzer | |
| D729,806 | S | 5/2015 | Park | |
| D731,489 | S | 6/2015 | Langhammer | |
| D732,536 | S | 6/2015 | Kang | |
| D733,142 | S | 6/2015 | Solomon | |
| 9,147,977 | B2 | 9/2015 | Poulsen et al. | |
| D743,398 | S | 11/2015 | Smith | |
| D745,523 | S | 12/2015 | Magi | |
| D746,291 | S | 12/2015 | Solomon | |
| 9,251,930 | B1 * | 2/2016 | McNutt | H01B 11/002 |
| 9,257,805 | B2 | 2/2016 | Wang | |
| D752,590 | S | 3/2016 | Bragg et al. | |
| 2001/0049214 | A1 | 12/2001 | Billman | |
| 2004/0142589 | A1 | 7/2004 | Caveney | |
| 2005/0245125 | A1 | 11/2005 | Colantuono | |
| 2005/0277340 | A1 | 12/2005 | Gordon et al. | |
| 2006/0030184 | A1 | 2/2006 | Sakaki | |
| 2006/0094273 | A1 | 5/2006 | Mine et al. | |
| 2007/0049079 | A1 | 3/2007 | Nalwad et al. | |
| 2008/0105449 | A1 * | 5/2008 | Kenny | H01B 7/0233 174/34 |
| 2008/0311797 | A1 | 12/2008 | Aekins | |
| 2009/0017656 | A1 | 1/2009 | Lee | |
| 2009/0104821 | A1 | 4/2009 | Marti et al. | |
| 2010/0009567 | A1 | 1/2010 | Gyagang et al. | |
| 2010/0029122 | A1 | 2/2010 | Ferrus et al. | |
| 2010/0035471 | A1 | 2/2010 | Gaidosch | |
| 2010/0041527 | A1 | 2/2010 | Miller | |
| 2010/0206609 | A1 * | 8/2010 | Glew | H01B 7/295 174/103 |
| 2012/0015536 | A1 | 1/2012 | Huang et al. | |
| 2012/0094525 | A1 | 4/2012 | Maranto et al. | |
| 2012/0184118 | A1 | 7/2012 | Lee et al. | |
| 2012/0202389 | A1 | 8/2012 | Erickson | |
| 2013/0164967 | A1 | 6/2013 | Lu | |
| 2013/0248221 | A1 * | 9/2013 | Booth | H01B 7/189 174/103 |
| 2013/0260581 | A1 | 10/2013 | Kuo et al. | |
| 2014/0057485 | A1 | 2/2014 | Huang | |
| 2014/0273626 | A1 | 9/2014 | Sparrowhawk | |
| 2015/0229078 | A1 | 8/2015 | Caveney et al. | |
| 2015/0295350 | A1 | 10/2015 | Bragg | |
| 2016/0036179 | A1 | 2/2016 | Bragg et al. | |

FOREIGN PATENT DOCUMENTS

| | | |
|---|---|---|
| EP | 1 753 093 | 2/2007 |
| FR | 2 982 431 | 5/2013 |
| GB | 2343558 | 5/2000 |
| JP | 2006-318801 | 11/2006 |
| WO | 0051206 | 8/2000 |
| WO | 2005025007 | 3/2005 |
| WO | 2011-087480 | 7/2011 |

(56) References Cited

FOREIGN PATENT DOCUMENTS

| | | |
|---|---|---|
| WO | 2013063233 | 5/2013 |
| WO | 2015056246 | 4/2015 |

OTHER PUBLICATIONS

PCT International Search Report and Written Opinion in corresponding International application No. PCT/US2015/025621, mailed Aug. 10, 2015.
Non-Final Office Action. dated Apr. 13, 2016, received in U.S. Appl. No. 14/883,267.
Non-Final Office Action. dated Apr. 13, 2016, received in U.S. Appl. No. 14/685,379.
Information Disclosure Statement Transmittal filed herewith.
Non-Final Office Action, dated Jul. 21, 2016, received in U.S. Appl. No. 14/883,415.
PCT International Search Report and Written Opinion in International application No. PCT/US2016/056374, mailed Jan. 24, 2017.
PCT International Search Report and Written Opinion in International application No. PCT/US2016/056499, mailed Jan. 29, 2017.
PCT International Search Report and Written Opinion in International application No. PCT/US2017/015709, mailed May 17, 2017.
Notice of Allowance, dated December 13, 2016, received in U.S. Appl. No. 15/135,870.
Non-Final Office Action, dated Apr. 26, 2017, received in U.S. Appl. No. 15/341,933.
Extended European Search Report, dated Aug. 28, 2017, received in European Application No. 15 780 127.

* cited by examiner

COMMUNICATIONS CONNECTOR SYSTEM

CROSS REFERENCE TO RELATED APPLICATION(S)

This application is a continuation of U.S. application Ser. No. 14/211,624, filed Mar. 14, 2014, which claims the benefit of U.S. Provisional Application No. 61/789,271, titled, Communications Connector System, filed on Mar. 15, 2013, which is incorporated herein by reference in its entirety.

BACKGROUND OF THE INVENTION

Field of the Invention

The present invention is directed generally to communications connector systems and related structures.

Description of the Related Art

A transmission line may have a first end opposite a second end. The second end may be attached to a load and referred to as a "load" end. The first end may be connected to a signal source. If the transmission line has constant impedance along its length, the transmission line will not reflect signals.

However, the time-rate-of-change in electrical signals, by nature, creates changing and propagating electric and magnetic fields along a transmission line. The objective of a transmission line is to contain these fields and to deliver them from one point in space to another and minimize the affect of external fields on the integrity of signal transmission along the line.

There are several ways to contain these fields along what is commonly known by those of ordinary skill in the art as Transverse Electric and Magnetic ("TEM") transmission lines, e.g., lines having electrical conductors along the length of the line.

One TEM transmission line structure having shielded wires is known as a coaxial line where one conductor is tubular and shares the same axis with a second "coaxial" conductor. The tubular conductor is commonly called a "shield" and the other conductor is called the "center conductor." Any voltage field created by the center conductor is intercepted by the shield, and any magnetic field generated by the center conductor is cancelled by the return of the same current from the load end thereby containing the electric and magnetic fields along the line. Since each conductor in this coaxial transmission line is not treated equally, it is called an unbalanced transmission line.

Alternatively, another TEM type transmission line structure is a differential wire pair transmission line. With differential transmission lines, the electric and magnetic fields are approximately cancelled by identical conductors (e.g., wires) with exactly opposite signals that share nearly the same space. The electric and magnetic fields are thus mostly contained in or around the conductors and a nearly insignificant portion of each field escapes the region near these "paired" conductors. This is called a balanced, or differential, transmission line. At a cost, a shield can be added to this differential pair to contain the "nearly insignificant" leakage field to the point where it can become insignificant.

In the process of a transmission line guiding electrical energy from one point to another, the electrical energy is in the form of varying voltages and currents that relate to each other by means of the impedance, which may be characteristic of a transmission line. Just as "Ohm's Law" applies to Direct Current ("DC"), characteristic impedance applies to time variant signals by setting the ratio of voltage to current on an infinitely long transmission line. It is symbolized by "$Z_o$" and expressed in units of "Ohms." Ideally this would be a simple injection of a signal into the "source end" of the transmission line and, after some propagation delay, the same signal arrives at the "load end" of the transmission line. Changes in, or discontinuities of, the transmission line's impedance, however, may cause some of the signal to reflect back upon itself. As understood by those of ordinary skill in the art, such reflection is described by the reflection coefficient, which preferably is zero:

$$\Gamma = \frac{Z_L - Z_S}{Z_L + Z_S}$$

The subscripted Z's above are load-side and source side-impedances.

These reflections can occur anywhere along the TEM transmission line. There are usually many reflections in a TEM line. Such reflections are created by imperfections in the transmission cable uniformity which may be caused by a variety of reasons including imperfections in the manufacturing process, "dimensional" damage, conductor termination at connectors or transmission between source/generator and load/receiver that is unmatched to the transmission line's characteristic impedance.

The reflections in TEM transmission lines of various delays, amplitudes and spectral energies combine to obscure the original forward propagating signal. To minimize signal reflections and maximize the delivery of an unadulterated signal along the TEM transmission line, the transmission line system must be terminated by connectors at both ends of the line that maintain impedances equal to the characteristic impedance of the transmission line.

Although there are specific formulae that designate the impedance for different transmission line configurations, fundamentally the formula below indicates the parameters affecting the impedance of transmission lines:

$$Z_0 \propto \sqrt{\frac{L_{UNIT_LENGTH}}{C_{UNIT_LENGTH}}}$$

The above formula indicates that the transmission line impedance will be lower if unit-length capacitance (represented by variable "C") increases, or vice versa. Unit-length inductance (represented by variable "L") typically does not change because materials associated with transmission lines typically do not have magnetic permeability characteristics that are different from "free space" which would alter this baseline inductance.

However, common insulator/dielectric materials that may surround a transmission line do alter free space permittivity and may alter capacitance. Geometric distances between the two conductors of a transmission line are easily altered and such alteration may also alter capacitance as reflected in the following formula:

$$C = \frac{\varepsilon A}{d}$$

The above formula indicates that for a small but constant area, the capacitance increases as distance (represented by variable "d") decreases. The variable "∈" represents a permittivity constant for the material in the vicinity of the transmission line and increases with increasing capacitance.

In sum, for a given dielectric material, the distance between two conductors of a transmission line affects the characteristic impedance of the cable and, in turn, would also affect the reflection of the transmission line if the capacitance changes along the longitudinal distance of the transmission line.

Excluding manufacturing non-uniformities and cable damage, the typical cause of unwanted reflections in a transmission line system is the dielectric and dimensional disturbance caused by connections that interrupt the geometry of transmission line cabling. This occurs because the cable must be cut and disassembled, usually involving splaying of the shield and wire (or wires if differential), thus causing a disturbance to the dielectric and the conductor spacing.

Any shielding of the differential pair of a transmission line may also affect the capacitance between the two differential conductors of the pair thereby creating reflections as discussed above. Moreover, if such a shield is a metal foil, it will usually expand away from the wire or wire pairs, but may also be cut or torn irregularly at one or more points along the transmission line thereby creating non-uniformities and mismatches between the transmission line, its shield, and any shielding provided by the connectors to which the transmission line may be connected.

In the case of a coaxial transmission line, the shield is one of the two transmission line conductors. In the case of a differential pair, however, the conductive shield is typically positioned intermediate the differential pair conductors and the cable jacket that may act as a capacitive stepping-stone, or shunt, that profoundly affects the sum-total capacitance between the transmission line's conductor pair thereby affecting the impedance of the system in a connector termination zone.

Traditionally, the use of a single drain wire to ground transmission lines operating at lower operational bandwidths/frequencies sufficed for adequate performance of a shielded transmission line. At higher operational bandwidths/frequencies, however, where the foil ends and the drain wire continues, the drain wire simply introduces a constriction in the cable ground. The gap between the end of the foil and the shielded connector becomes an unwanted aperture at these wavelengths.

If the length of this "disrupted shield" impedance discontinuity is significantly shorter than the shortest wavelength transmitted by the differential transmission line, the impedance will essentially go undetected because the low-to-high reflection and the high-to-low reflection at each end of the short discontinuity will cancel each other. However, shielding effectiveness would be disrupted if the shield was deformed so as to uncover a portion of the transmission line wires it originally encompassed.

As bandwidth needs increase, frequencies transmitted increase, and the wavelengths become shorter. Reflections at either end of the impedance discontinuity are no longer close enough together to be near enough to 180 degrees (or PI radians) out of phase, thus the low-to-high reflection and the high-to-low reflection will not cancel one another sufficiently to go unnoticed. Therefore, the system becomes vulnerable to shorter and shorter discontinuities and more care needs to be taken.

Thus, a need exists for devices configured to minimize reflections attributable to a connector termination zone, including disturbances caused by cable shielding, and the process of assembling a connector onto the end of a transmission line. A need also exists to improve the effectiveness of cable shielding by improved continuity of the shield in the vicinity of the disturbance created by assembling the end of the cable to a connector. A need also exists to reduce the dependency on an inductive drain wire to ground the shielding of a cable. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1:
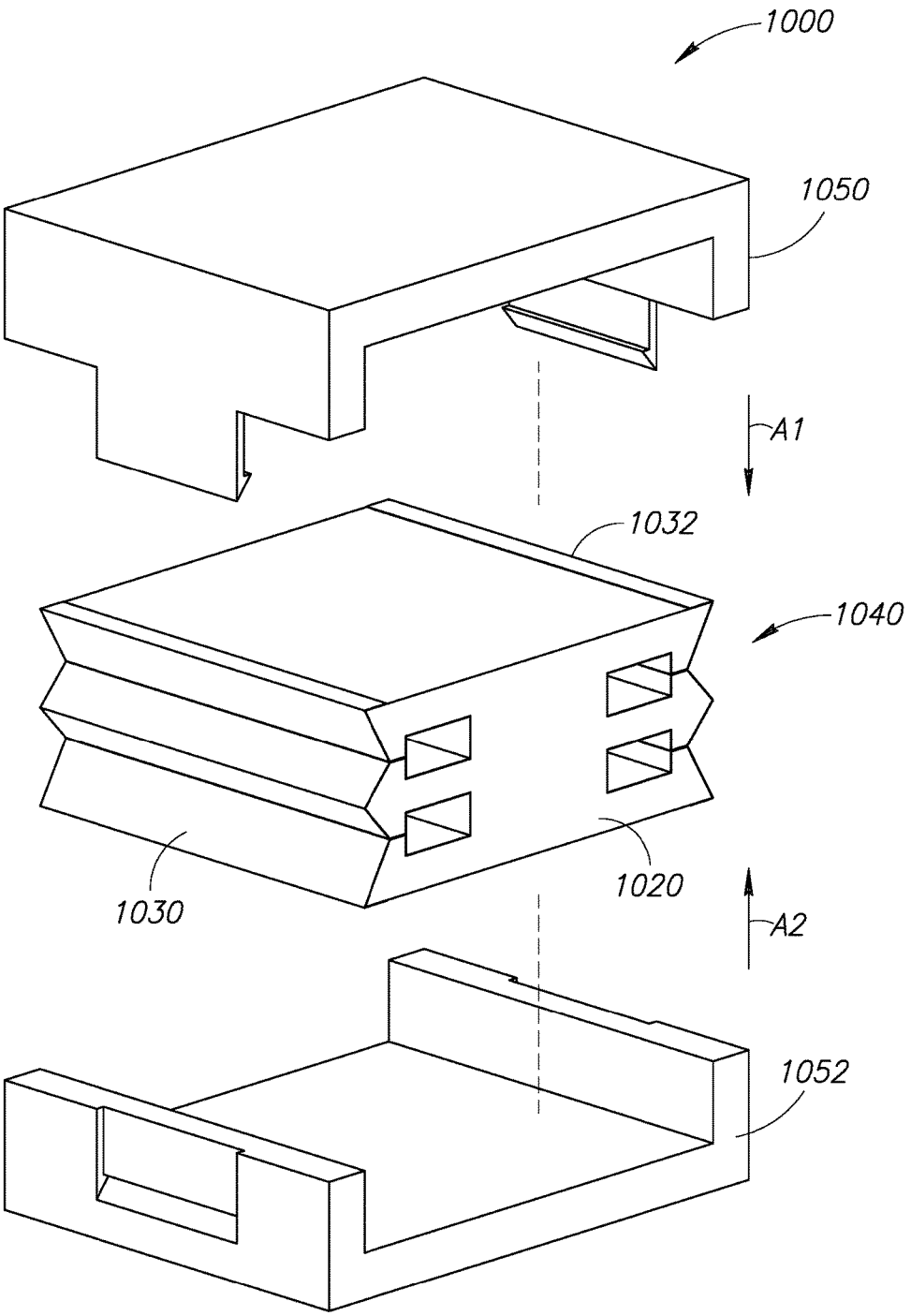
FIG. 1 is a partially exploded perspective view of a reinstated shield assembly.

Both foiled twisted pair ("FTP") and shielded twisted pair ("STP") type cables include individually wrapped wire pairs. Small form factor pluggable ("SFP") cables include wire pairs that, while not twisted together, are individually wrapped. Specifically, each wire pair is wrapped in a conductive pair shield. Also, unfortunately, dealing with the pair shields adds complexity and cost to terminating such cables at communication connectors because end portions of the pair shields must be removed to provide access to end portions of the wire pairs. Unfortunately, removing the end portions of the pair shields removes the desirable shielding provided by the pair shields.

For example, when a cable is terminated at a communication connector, the pair shields may be allowed to simply "float" electrically. This is generally not recommended due to the longitudinal resonant nature of the "floating" pair shields. Sometimes, the end portions of the pair shields are removed in an uncontrolled manner that leaves an indeterminate exposure region along the unshielded end portions of the wire pairs. However, if the cable includes a drain wire, a metal to metal connection may be achieved by connecting the drain wire to the connector, which will relieve at least some of the problems associated with allowing the pair shields to float. Unfortunately, the drain wire does not help control high frequency transmission parameters in the same manner as the pair shields. Some prior art communication connectors include a metallic assembly (e.g., housing) that includes a depression that may re-encompass the exposed portions of wire pairs that extend beyond the pair shielding. This solution avoids a large "leaky" exposed region; however, there still is an "impedance lump."

Therefore, a need exists for methods and structures that reinstate the pair shielding at the exposed end portions of the wire pairs.

Reinstated Shield Assembly

Initially, as manufactured, the shield within a cable is intimately compressed against the insulation of the wire, or "wires" in the instance of a differential transmission line. If this shield is removed, it is easy to reinstate because the surface of the wire insulation is a definitive barrier to inward movement of a new compliant metal piece that will replace the shield that was once there prior to being disturbed or removed. A compliant metal piece such as a piece of metallic foil or wire braid, metallic wool, metallic powder, or even liquid metal such as Mercury or molten Tin, could act as a replacement shield that is inwardly limited by the wire insulation. Longitudinally, on the cable side of this "termination" assembly, the replacement shield will overlap the entire region where the original shield will either be disturbed or removed in some chaotic manner. The connector side of this replacement shield will be accurately defined so as to end in a location that will allow the conductive components of the conductor to pick up that shield's function as it relates to impedance control and its electrical connection.

At the scale of typical cable and related foil, considerable transverse (radial) pressure must be applied to cause even 0.002" foil with 0.001" plastic film along with some adhesive to reform back onto the wire insulator surface. To accomplish this, a corset-like device may be used to generate forces in the desired direction(s). For example, referring to FIG. 1, a reinstated shield assembly 1000 may be used. The reinstated shield assembly 1000 brings a new shield conductor (which includes first and second electrically conductive members 1030 and 1032) into proximity with pair shields 1121-1124 (see FIG. 7) surrounding wire pairs "P1" to "P4," respectively. In the reinstated shield assembly 1000, a housing 1010 presses the new shield conductor against the pair shields 1121-1124 (see FIG. 7).

The complexity of the reinstated shield assembly 1000 may vary depending upon the quality of the shield reinstatement desired for the application. For example, referring to FIG. 3 the housing 1010 (see FIGS. 1 and 2) may include a contoured inner surface (not shown) configured to apply force at specific locations of a compressible member 1020 such that slits 1068A-1068D (and through-channels 1078A-1078D, if present) formed in the compressible member 1020 fully close against the wire pairs "P1" to "P4" and pair shields 1121-1124 therein in a sphincter-like manner. If this is inadequate (e.g., due to performance requirements, stiff disturbed shield material, stiff shield reinstatement material, or the like), a more complex compaction mechanism may be used. For example, the compressible member 1020 may be compressed by a surrounding (optionally spiraled or zigzagged) cord that when tensioned, compresses the compressible member 1020 onto the new shield conductor (which includes first and second electrically conductive members 1030 and 1032) adjacent the wire pairs "P1" to "P4" and pair shields 1121-1124.

Figure 2:
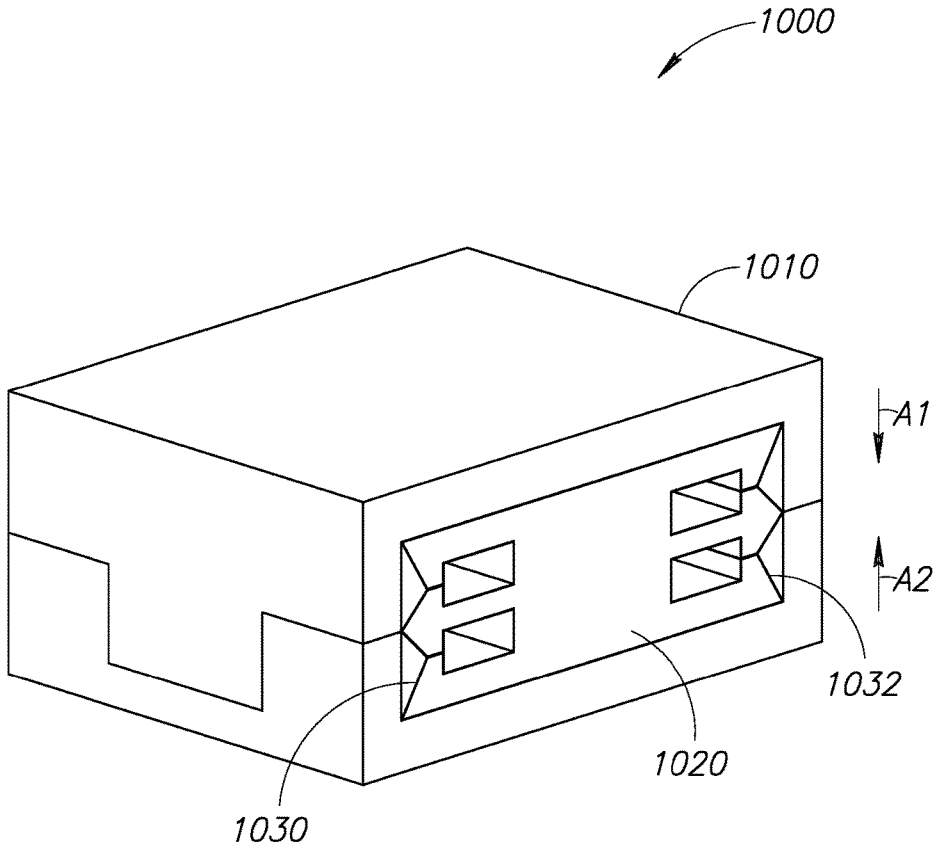
FIG. 2 is a perspective view of the reinstated shield assembly of FIG. 1.
Figure 3:
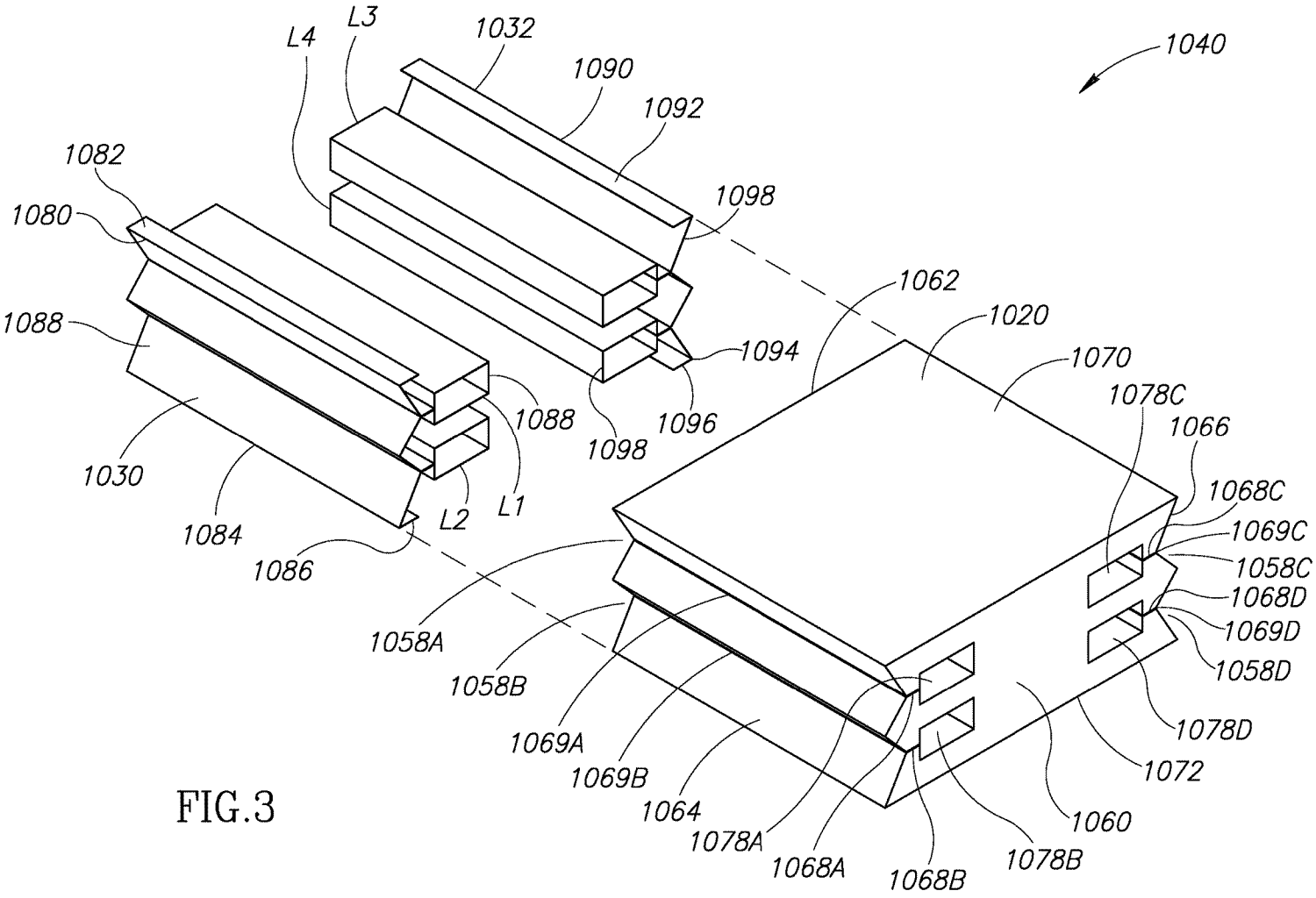
FIG. 3 is an exploded perspective view of a subassembly of the reinstated shield assembly of FIG. 1.
Figure 4:
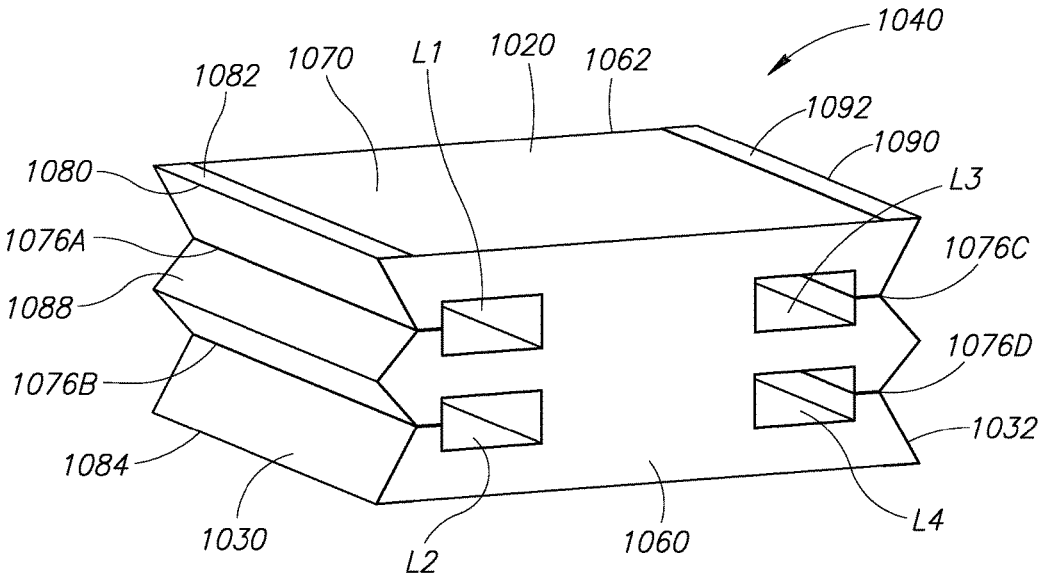
FIG. 4 is a perspective view of an upper portion of the subassembly of FIG. 3.
Figure 5:
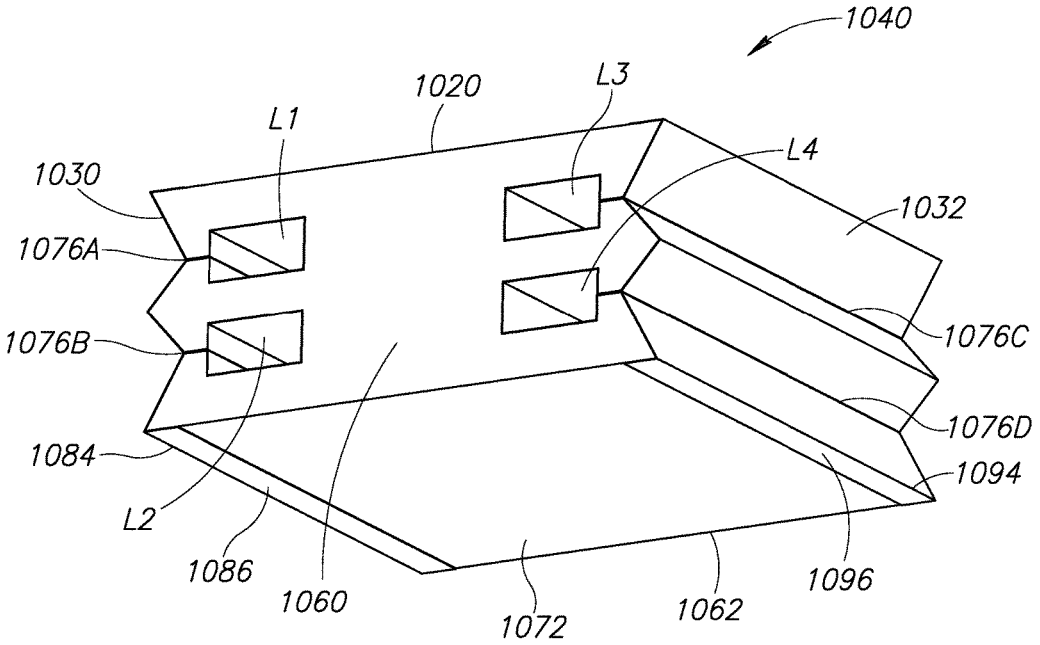
FIG. 5 is a perspective view of a lower portion of the subassembly of FIG. 3.

FIG. 1 is a partially exploded perspective view of the reinstated shield assembly 1000. FIG. 2 is a perspective view of the reinstated shield assembly 1000. The reinstated shield assembly 1000 includes the housing 1010 (see FIG. 2), the compressible member 1020, the first electrically conductive member 1030, and the second electrically conductive member 1032. Turning to FIG. 1, when assembled together, the compressible member 1020 and the first and second electrically conductive members 1030 and 1032 form a subassembly 1040. FIG. 3 is an exploded perspective view of the subassembly 1040. FIG. 4 is a perspective view of an upper portion of the subassembly 1040. FIG. 5 is a perspective view of a lower portion of the subassembly 1040.

Returning to FIG. 2, the housing 1010 is configured to house and compress the subassembly 1040 in directions identified by arrows "A1" and "A2." Optionally, the housing 1010 may compress the subassembly 1040 in directions orthogonal to the directions identified by the arrows "A1" and "A2." The housing 1010 may include a first housing portion 1050 and a second housing portion 1052. In the embodiment illustrated, the first and second housing portions 1050 and 1052 snap together and vertically compress the subassembly 1040 in the directions identified by the arrows "A1" and "A2."

Referring to FIG. 3, the compressible member 1020 includes a front portion 1060 opposite a rear portion 1062. The compressible member 1020 further includes a first side portion 1064 that extends between the front and rear portions 1060 and 1062, and a second side portion 1066 that is opposite the first side portion 1064 and extends between the front and rear portions 1060 and 1062. The compressible member 1020 includes an upper portion 1070 that extends between the first and second side portions 1064 and 1066 and between the front and rear portions 1060 and 1062. A lower portion 1072 is opposite the upper portion 1070 and also extends between the first and second side portions 1064 and 1066 and between the front and rear portions 1060 and 1062.

In the embodiment illustrated, cutouts or recesses 1058A-1058D are formed in the compressible member 1020. The recesses 1058A and 1058B are formed in the first side portion 1064, and the recesses 1058C and 1058D are formed in the second side portion 1066. In the embodiment illustrated, the recesses 1058A-1058D are each generally V-shaped, which gives each of the first and second side portions 1064 and 1066 a generally W-shaped profile when viewed from in front of (or behind) the compressible member 1020. However, this is not a requirement.

The compressible member 1020 includes the plurality of spaced apart inwardly extending slits 1068A-1068D that extend between the front and rear portions 1060 and 1062. In the embodiment illustrated, the slits 1068A and 1068B are each formed along the first side portion 1064 and include openings 1069A and 1069B, respectively, that extend along the first side portion 1064 between the front and rear portions 1060 and 1062. The slits 1068C and 1068D are each formed along the second side portion 1066 and include openings 1069C and 1069D, respectively, that extend along the second side portion 1066 between the front and rear portions 1060 and 1062. In the embodiment illustrated, the openings 1069A-1069D are positioned in the recesses 1058A-1058D, respectively. The compressible member 1020 is sufficiently flexible to allow the openings 1069A-1069D to be widened and/or pressed closed.

Optionally, the compressible member 1020 includes the open-ended spaced apart through-channels 1078A-1078D that extend between and are open at the front and rear portions 1060 and 1062. In such embodiment, the slits 1068A-1068D extend into the through-channels 1078A-1078D, respectively. Thus, the slits 1068A and 1068B provide inwardly extending throughways or passages into the through-channels 1078A and 10786, respectively, from the first side portion 1064. Similarly, the slits 1068C and 1068D provide inwardly extending throughways or passages into the through-channels 1078C and 1078D, respectively, from the second side portion 1066.

In the embodiment illustrated in FIG. 4, the first electrically conductive member 1030 extends continuously along the first side portion 1064 (see FIG. 3) of the compressible member 1020 from the front portion 1060 to the rear portion 1062. The first electrically conductive member 1030 includes an upper bend or fold 1080 that defines an upper portion 1082 that is positioned on the upper portion 1070 of the compressible member 1020. In the embodiment illustrated in FIG. 5, the first electrically conductive member 1030 includes a lower bend or fold 1084 that defines a lower portion 1086 that is positioned on the lower portion 1072 of the compressible member 1020. Returning to FIG. 3, the first electrically conductive member 1030 includes an intermediate portion 1088 that extends between the upper and lower folds 1080 and 1084 and lines the recesses 1058A and 1058B, the slits 1068A and 1068B, and if present, the through-channels 1078A and 1078B. Thus, the first electrically conductive member 1030 electrically couples together the slits 1068A and 10686, and if present, the through-channels 1078A and 1078B.

In embodiments in which the first electrically conductive member 1030 is constructed from a flexible material (e.g., foil), the portions of the intermediate portion 1088 that line the recesses 1058A and 10586 may be characterized as being slack. When the compressible member 1020 is stretched or otherwise changes shape, the presence of this slack portion allows the intermediate portion 1088 to straighten to accommodate the change in shape.

The portion of the intermediate portion 1088 that lines the slit 1068A (and the through-channel 1078A, if present) may be characterized as forming a first loop "L1," and the portion of the intermediate portion 1088 that lines the slit 10686 (and the through-channel 10786, if present) may be characterized as forming a second loop "L2." Turning to FIG. 4, an opening 1076A is defined in the first loop "L1" that is adjacent the opening 1069A of the slit 1068A. Similarly, an opening 1076B is defined in the second loop "L2" that is adjacent the opening 1069B of the slit 1068B.

In the embodiment illustrated in FIG. 5, the second electrically conductive member 1032 extends continuously along the second side portion 1066 (see FIG. 3) of the compressible member 1020 from the front portion 1060 to the rear portion 1062. Turning to FIG. 4, the second electrically conductive member 1032 includes an upper bend or fold 1090 that defines an upper portion 1092 that is positioned on the upper portion 1070 of the compressible member 1020. In the embodiment illustrated in FIG. 4, the second electrically conductive member 1032 includes a lower bend or fold 1094 that defines a lower portion 1096 that is positioned on the lower portion 1072 of the compressible member 1020. Returning to FIG. 3, the second electrically conductive member 1032 includes an intermediate portion 1098 that extends between the upper and lower folds 1090 and 1094 and lines the recesses 1058C and 1058D, the slits 1068C and 1068D, and if present, the through-channels 1078C and 1078D. Thus, the second electrically conductive member 1032 electrically couples together the slits 1068C and 1068D, and if present, the through-channels 1078C and 1078D.

In embodiments in which the second electrically conductive member 1032 is constructed from a flexible material (e.g., foil), the portions of the intermediate portion 1098 that line the recesses 1058C and 1058D may be characterized as being slack. When the compressible member 1020 is stretched or otherwise changes shape, the presence of this slack portion allows the intermediate portion 1098 to straighten to accommodate the change in shape.

The portion of the intermediate portion 1098 that lines the slit 1068C (and the through-channel 1078C, if present) may be characterized as forming a third loop "L3," and the portion of the intermediate portion 1098 that lines the slit 1068D (and the through-channel 1078D, if present) may be characterized as forming a fourth loop "L4." Turning to FIG. 5, an opening 1076C is defined in the third loop "L3" that is adjacent the opening 1069C of the slit 1068D. Similarly, an opening 1076D is defined in the fourth loop "L4" that is adjacent the opening 1069D of the slit 1068D.

Figure 6:
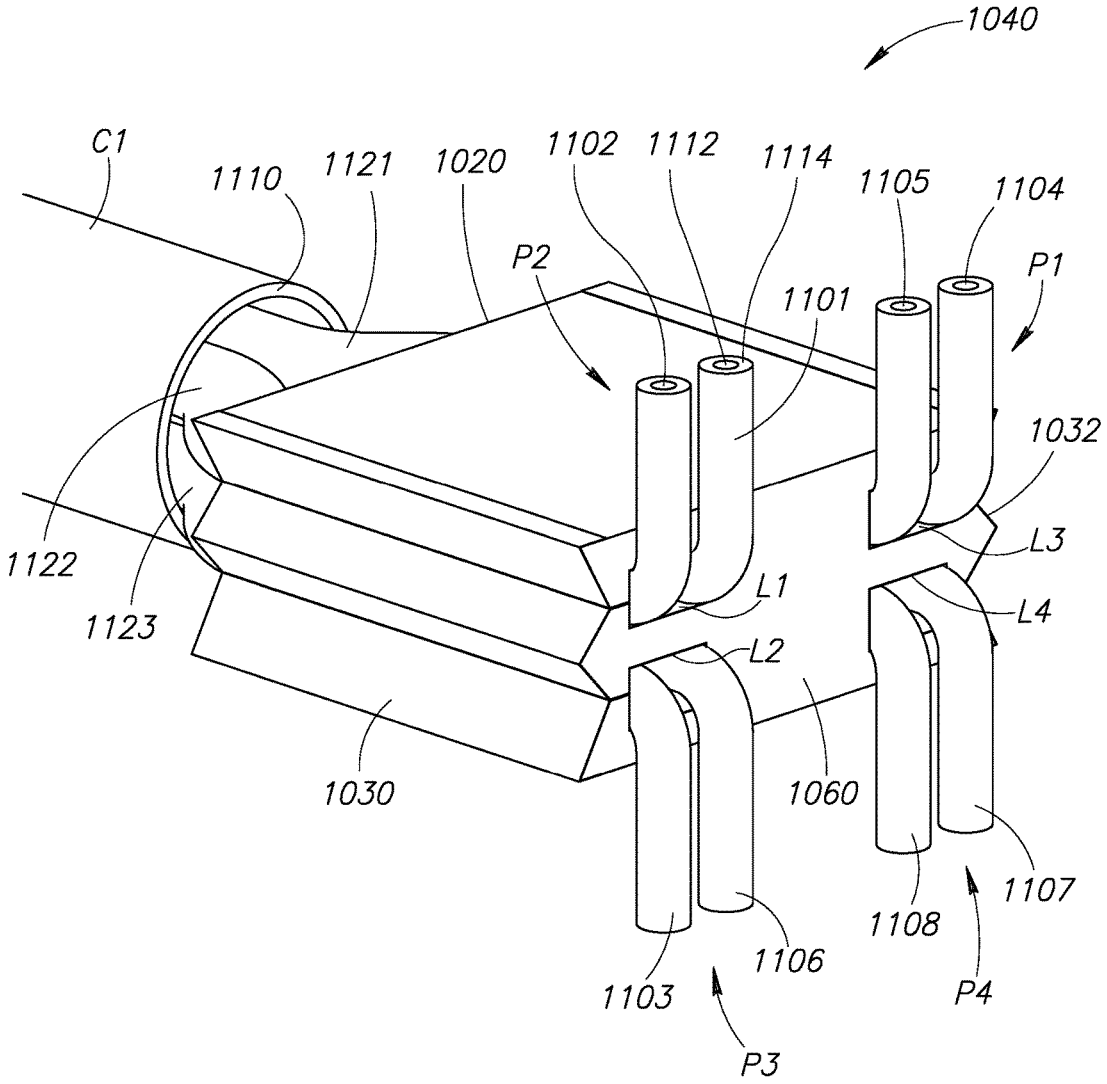
FIG. 6 is a perspective view of the subassembly of FIG. 3 and a first conventional communications cable.

FIG. 6 is a perspective view of the subassembly 1040 and a conventional communications cable "C1." The cable "C1" includes eight wires 1101-1108 substantially identical to one another. For the sake of brevity, only the structure of the wire 1101 will be described. As is appreciated by those of ordinary skill in the art, the wire 1101 as well as the wires 1102-1108 each includes an electrical conductor 1112 (e.g., a conventional copper wire) surrounded by an outer layer of insulation 1114 (e.g., a conventional insulating flexible plastic jacket).

The wires 1101-1108 are arranged in four wire pairs that may optionally be twisted together in an arrangement often referred to as "twisted pairs". A first wire pair "P1" includes the wires 1104 and 1105. A second wire pair "P2" includes the wires 1101 and 1102. A third wire pair "P3" includes the wires 1103 and 1106. A fourth wire pair "P4" includes the wires 1107 and 1108. The wires 1101-1108 are housed inside an outer cable sheath 1110 typically constructed from an electrically insulating material.

Each of the wire pairs "P1" to "P4" serves as a conductor of a differential signaling pair wherein signals are transmitted thereupon and expressed as voltage and/or current differences between the wires of the wire pair. A wire pair can be susceptible to electromagnetic sources including another nearby cable of similar construction. Signals received by the wire pair from such electromagnetic sources external to the cable's jacket are referred to as "alien crosstalk." The wire pair can also receive signals from one or more wires of the three other wire pairs within the cable's jacket, which is referred to as "local crosstalk" or "internal crosstalk."

Optionally, the cable "C1" may include a conventional drain wire (not shown). The drain wire may pass through or alongside the compressible member 1020. As is appreciated by those of ordinary skill in the art, the drain wire (not shown) may be connected to a frame (not shown) of a communications connector (e.g., an outlet 1300 depicted in FIG. 9) for additional assurance of a low "ohmic" connection. Optionally, the drain wire (not shown) may contact at least one of the first and second electrically conductive members 1030 and 1032. However, this is not a requirement.

Optionally, the cable "C1" may include a conventional cable shield (not shown) that extends inside the outer cable sheath 1110 and surrounds all four of the wire pairs "P1" to "P4." The cable shield (not shown) may be constructed using any material suitable for constructing the first and second electrically conductive members 1030 and 1032. Optionally, the cable shield (not shown) may contact at least one of the first and second electrically conductive members 1030 and 1032. However, this is not a requirement.

The cable "C1" has been illustrated as being an FTP or STP type cable. However, through application of ordinary skill in the art to the present teachings, the reinstated shield assembly 1000 may be modified for use with other types of cables that include wire pairs, such as screened twisted pair ("ScTP") type cables, and the like. In particular, the cable "C1" may be implemented using any type of cable in which the wire pairs are not twisted together, such as the biaxial shielded pairs found within SFP type cables, and quad small form factor pluggable ("QSFP") type cables, and the like.

Figure 7:
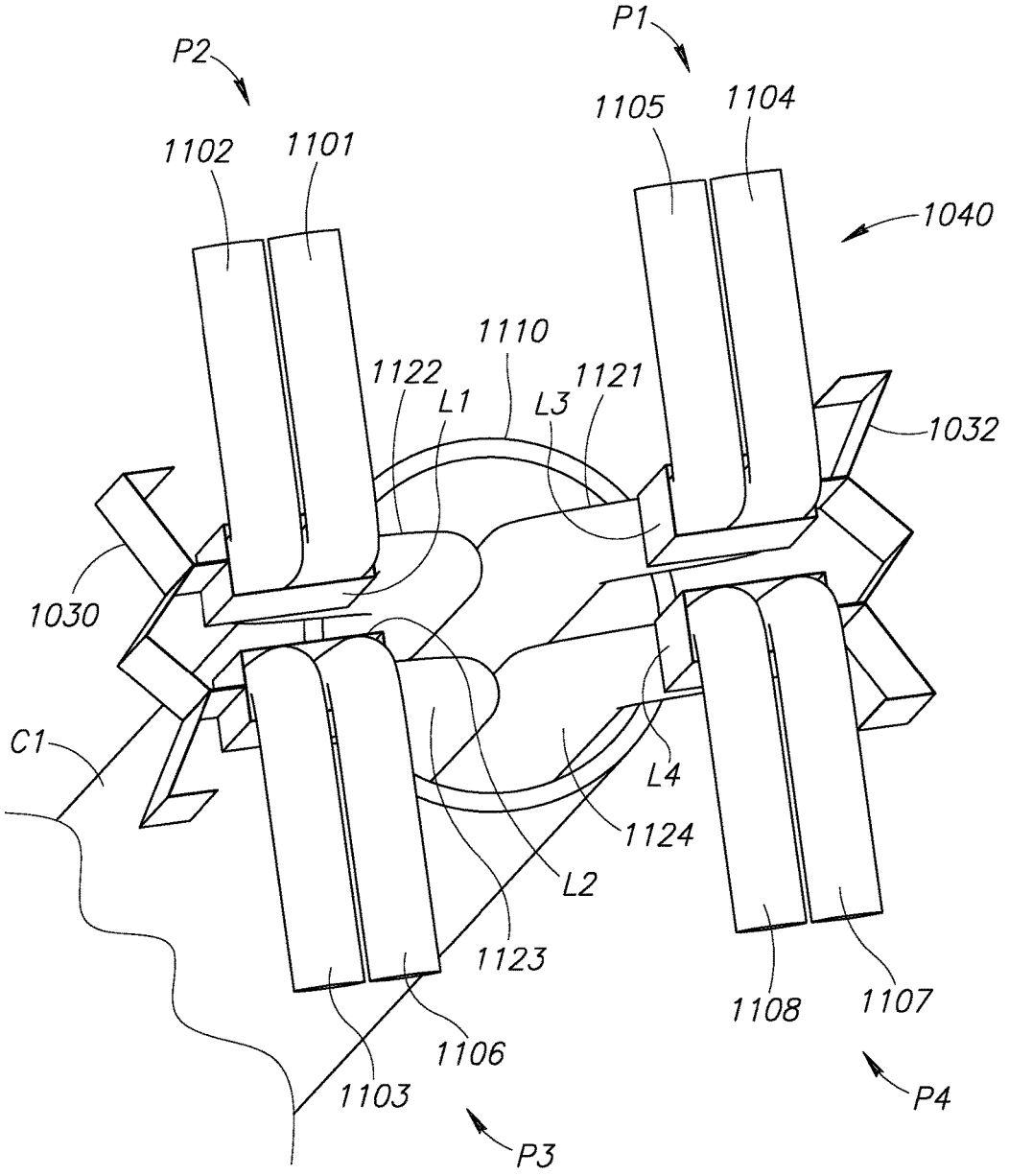
FIG. 7 is a first perspective view of the first cable and the subassembly of FIG. 3 in which a compressible member of the subassembly has been omitted.
Figure 8:
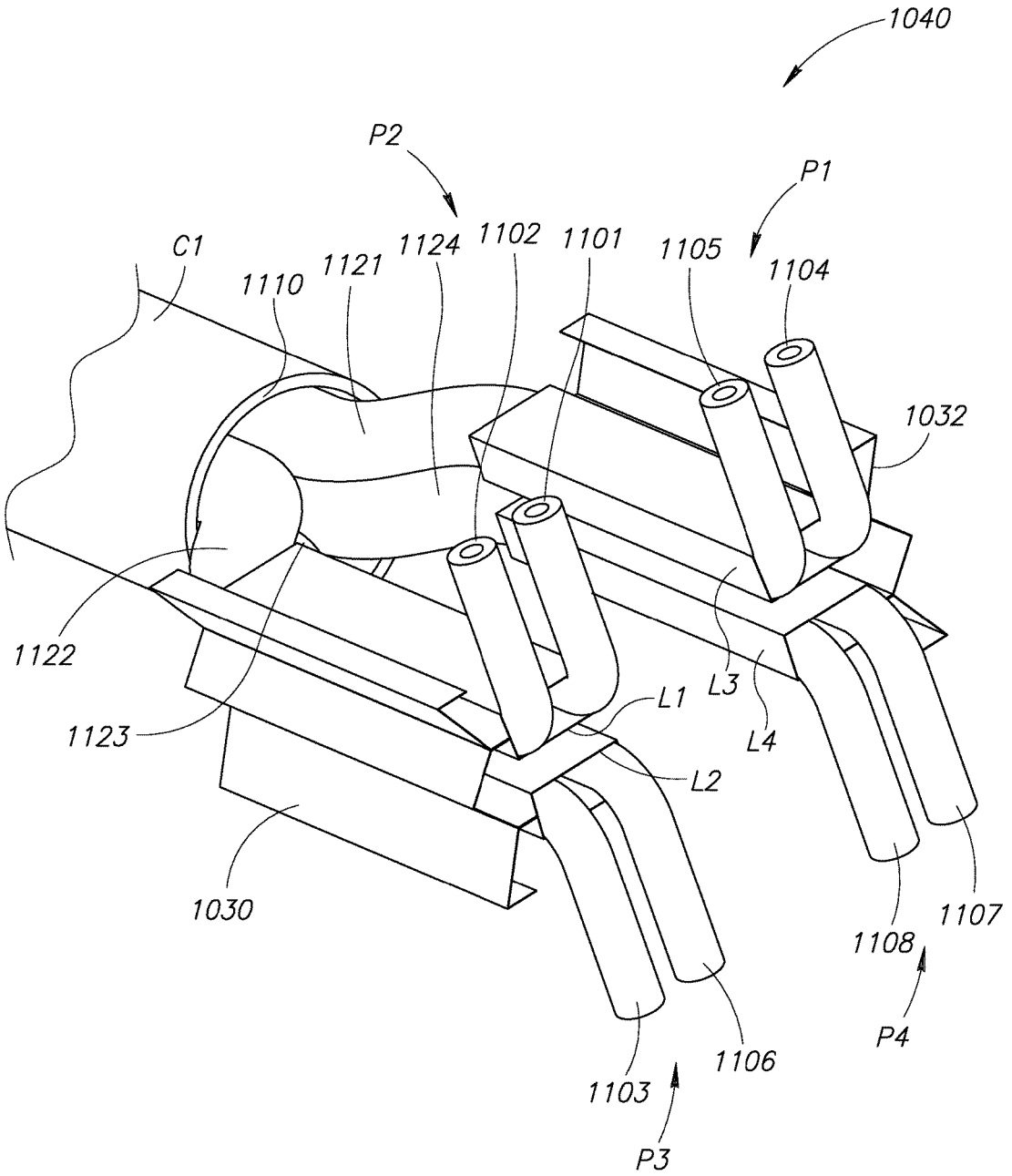
FIG. 8 is a second perspective view of the first cable and the subassembly of FIG. 3 in which the compressible member has been omitted.

FIG. 7 is a first perspective view of the cable "C1" and the subassembly 1040 in which the compressible member 1020 has been omitted. FIG. 8 is a second perspective view of the cable "C1" and the subassembly 1040 in which the compressible member 1020 has been omitted. Referring to FIGS. 7 and 8, the wire pairs "P1" to "P4" are surrounded circumferentially by the conventional substantially electrically conductive pair shields 1121-1124, respectively. Each of the pair shields 1121-1124 may be constructed from foil, plastic film with a conductive coating, metallic creped foil or wire braid, metallic wool, metallic powder, liquid metal (such as Mercury or molten Tin), and the like.

The cable "C1" may be positioned behind the subassembly 1040 with the second wire pair "P2" positioned inside the first loop "L1" of the first electrically conductive member 1030, and the third wire pair "P3" positioned inside the second loop "L2" of the first electrically conductive member 1030. The second and third wire pairs "P2" and "P3" each extend outwardly from the front of the subassembly 1040 to be coupled to a communications connector (e.g., an outlet 1300 illustrated in FIG. 9). The pair shields 1122 and 1123 extend into and contact the first and second loops "L1" and "L2," respectively, but do not extend outwardly from the front of the subassembly 1040 along with the second and third wire pairs "P2" and "P3." Instead, the pair shields 1122 and 1123 terminate inside the first and second loops "L1" and "L2," respectively. Thus, the first electrically conductive member 1030 electrically couples together the pair shields 1122 and 1123 and extends them to the front portion 1060 (see FIG. 4) of the compressible member 1020 (see FIG. 4). The second and third wire pairs "P2" and "P3" may be inserted into the first and second loops "L1" and "L2," respectively, through the openings 1076A and 10766 (see FIG. 4), respectively.

The first wire pair "P1" is positioned inside the third loop "L3" of the second electrically conductive member 1032, and the fourth wire pair "P4" positioned inside the fourth loop "L4" of the second electrically conductive member 1032. The first and fourth wire pairs "P1" and "P4" each extend outwardly from the front of the subassembly 1040 to be coupled to a communications connector (e.g., the outlet 1300 illustrated in FIG. 9). The pair shields 1121 and 1124 extend into and contact the third and fourth loops "L3" and "L4," respectively, but do not extend outwardly from the front of the subassembly 1040 along with the first and fourth wire pairs "P1" and "P4." Instead, the pair shields 1121 and 1124 terminate inside the third and fourth loops "L3" and "L4," respectively. Thus, the second electrically conductive member 1032 electrically couples together the pair shields 1121 and 1124 and extends them to the front portion 1060 (see FIG. 5) of the compressible member 1020 (see FIG. 5). The first and fourth wire pairs "P1" and "P4" may be inserted into the third and fourth loops "L3" and "L4," respectively, through the openings 1076C and 1076D (see FIG. 5), respectively.

Optionally, referring to FIG. 6, the compressible member 1020 may extend rearwardly over a portion of the outer cable sheath 1110 for a short distance.

By way of non-limiting examples, the compressible member 1020 may be constructed from compressible substantially electrically non-conductive (or insulating) materials, such as open cell foam, closed cell foam, compressed air bladder, compressed fluid bladder, temporarily compressed air where the foil is subsequently retained by an applied adhesive upon the wire insulation, self-compliant metal, wool, or compressible foil wads, and the like. The compressible member 1020 may be formed using an extrusion process. The compressible member 1020 is dense and/or resilient enough to force the first and second electrically conductive members 1030 and 1032 into contact with the pair shields 1121-1124 when the compressible member 1020 is compressed (e.g., by the housing 1010 illustrated in FIGS. 1 and 2). For example, the compressible member 1020 may force portions of the first and second electrically conductive members 1030 and 1032 to mold around the wire pairs "P1" to "P4" when the compressible member 1020 is compressed (e.g., by the housing 1010 illustrated in FIGS. 1 and 2).

The first and second electrically conductive members 1030 and 1032 may each be constructed from substantially electrically conductive flexible materials, such as a metal foil, plastic film with a conductive coating, sprayed-on coating, creped metal foil, metal weaves, metal wool, and the like. The material used to construct the first and second electrically conductive members 1030 and 1032 may be patterned (e.g., using a zigzag pattern, a fractal pattern, and the like) or otherwise configured to "give," stretch, or incorporate slack so that the first and second electrically conductive members 1030 and 1032 may expand or otherwise change shape to match local wire topology. By way of non-limiting examples, the material may be about 0.0004 inches to about 0.0005 inches (or about 10 microns) thick. A rolling wheel may be used to force the material used to construct the first electrically conductive member 1030 into the slits 1168A and 1168B (see FIG. 3), and to force the material used to construct the second electrically conductive member 1032 into the slits 1168C and 1168D (see FIG. 3). Optionally, the first and second electrically conductive members 1030 and 1032 may be glued to the compressible member 1020. However, this is not a requirement.

The housing 1010 (see FIGS. 1 and 2) compresses the compressible member 1020 sufficiently to ensure the first, second, third, and fourth loops "L1," "L2," "L3," and "L4" contact the pair shields 1121, 1122, 1123, and 1124 (see FIGS. 7 and 8), respectively. In other words, the housing 1010 forces the first and second electrically conductive members 1030 and 1032 to substantially conform to the shapes of the wire pairs "P1" to "P4" to thereby reinstate the pair shields 1121-1124, respectively, in a manner that extends the pair shields 1121-1124 toward a communications connector (e.g., the outlet 1300 depicted in FIG. 9) connected to the wire pairs "P1" to "P4." This arrangement may approximate the electrical equivalent of providing such shielding inside the communications connector (e.g., the outlet 1300 depicted in FIG. 9) connected to the wire pairs "P1" to "P4." Thus, the reinstated shield assembly 1000 may help maintain shielding integrity and provide good return loss.

In alternative embodiments (not shown), the compressible member 1020 may include conductive elements (e.g., embedded metal structures) that may be pressed against the pair shields 1121-1124 by the housing 1010 (see FIGS. 1 and 2). In such embodiments, the first and second electrically conductive members 1030 and 1032 may be omitted. The conductive elements (not shown) may be constructed from a conductive mesh material, braided metal fibers, braided or chopped metal fibers incorporated into wool fabric, conductive paint, and the like.

In alternative embodiments (not shown), one or more electrically conductive members (not shown) may each be connected to all of the pair shields 1121-1124. In such embodiments, optionally, the compressible member 1020 may be implemented as two or more separate compressible members. For example, the one or more electrically conductive members (not shown) and the wire pairs "P1" to "P4" may be sandwiched between a first compressible member (not shown) and a second compressible member (not shown). The first and second compressible members (not shown) may be compressed (e.g., via a housing like the housing 1010 depicted in FIG. 2) to force the one or more electrically conductive members (not shown) against the pair shields 1121-1124.

Figure 9:
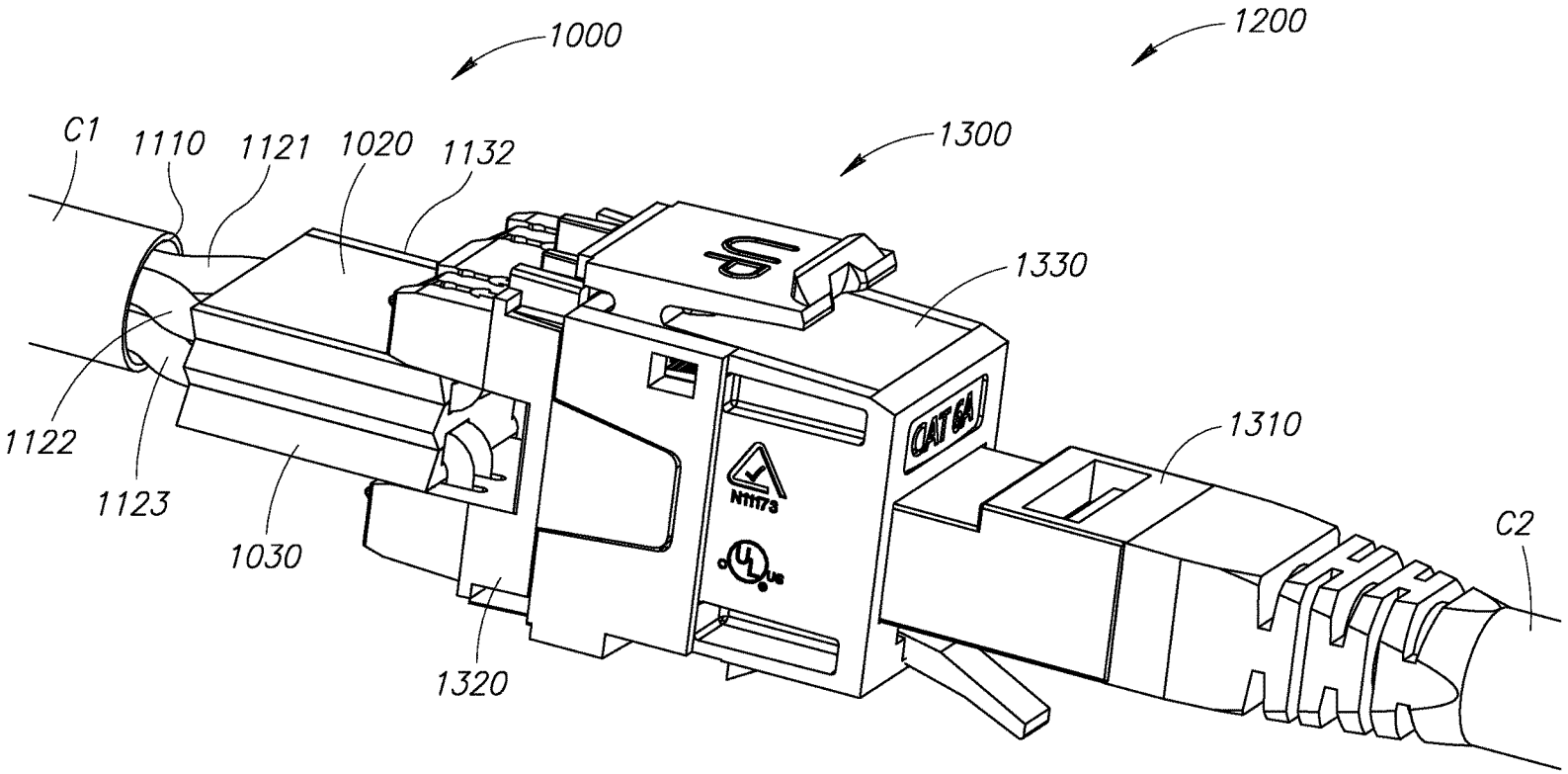
FIG. 9 is a perspective view of a connection that includes the first cable, the reinstated shield assembly of FIG. 1 (with its housing removed), an outlet, and a plug connected to a second cable.

FIG. 9 illustrates a connection 1200 that includes the cable "C1," the reinstated shield assembly 1000 with its housing 1010 (see FIGS. 1 and 2) removed, the outlet 1300, and a plug 1310 connected to a cable "C2." The cable "C2" is substantially identical to the cable "C1" and includes a plurality of wires (not shown) substantially identical to the wires 1101-1108 (see FIG. 8).

The outlet 1300 includes a carrier or terminal block 1320 and a dielectric housing or body 1330. The terminal block 1320 houses a plurality of wire connectors 1341-1348 (see FIGS. 10 and 12). The body 1330 is configured to receive the plug 1310 and houses a plurality of resilient tines or outlet contacts 1351-1358 (see FIGS. 11 and 12) positioned to make contact with a plurality of plug contacts (not shown) when the plug 1310 is received by the body 1330. The plug contacts terminate the wires (not shown) of the cable "C2."

Figure 10:
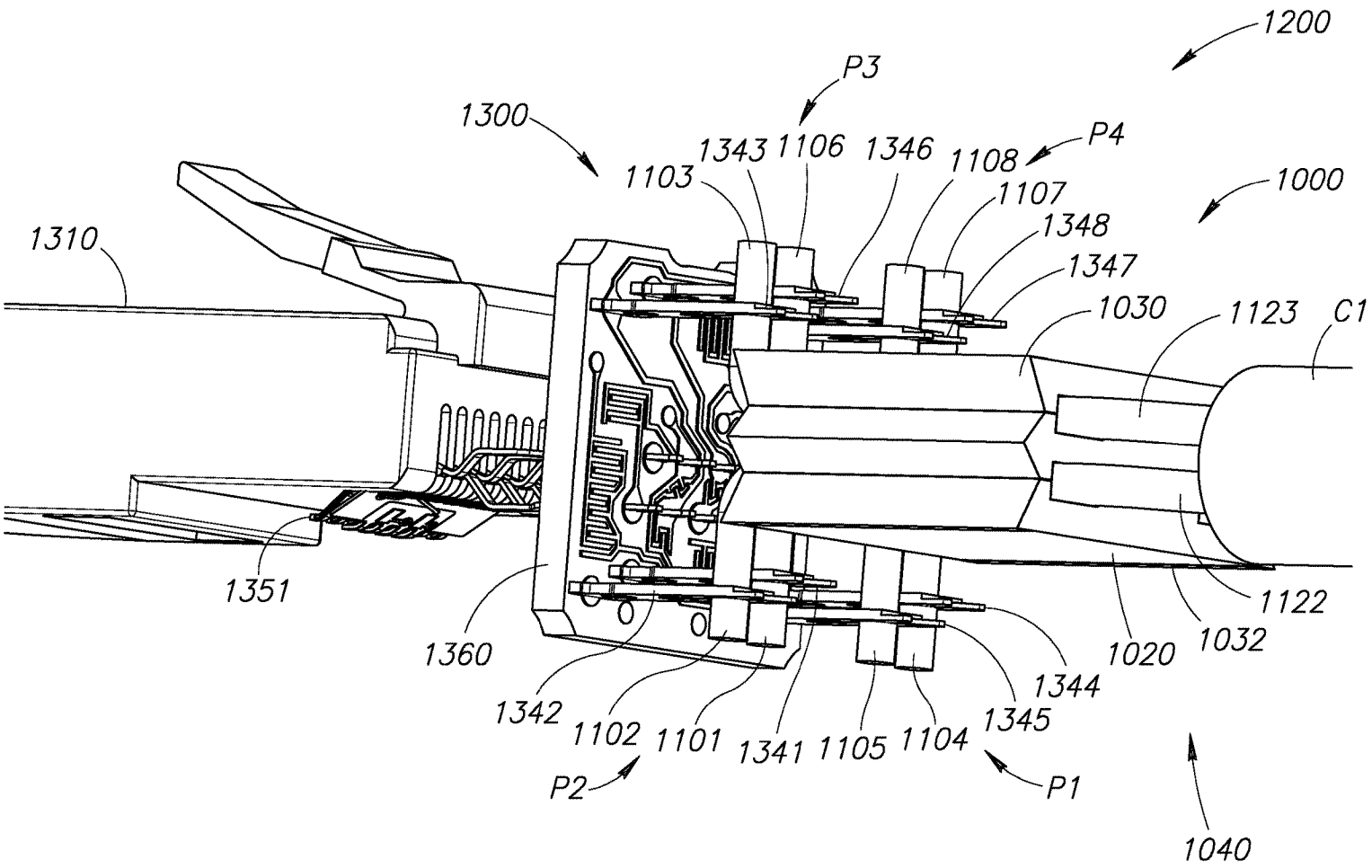
FIG. 10 is an enlarged perspective view of the connection of FIG. 9 omitting a terminal block and a body of the outlet, and the housing of the reinstated shield assembly of FIG. 1.
Figure 11:
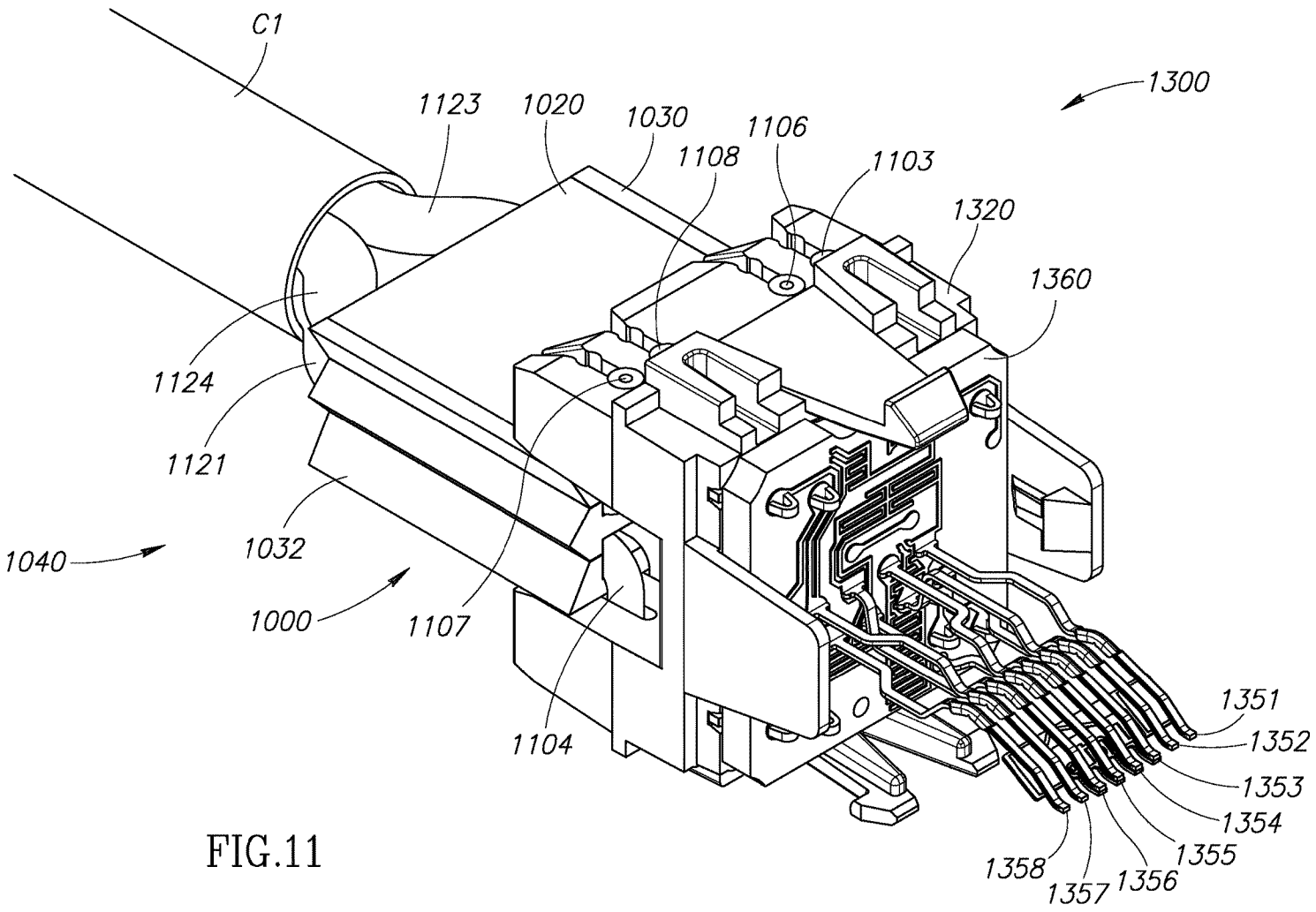
FIG. 11 is an enlarged perspective view of the first cable, the reinstated shield assembly of FIG. 1 (with its housing removed), and the outlet (with its body removed).
Figure 12:
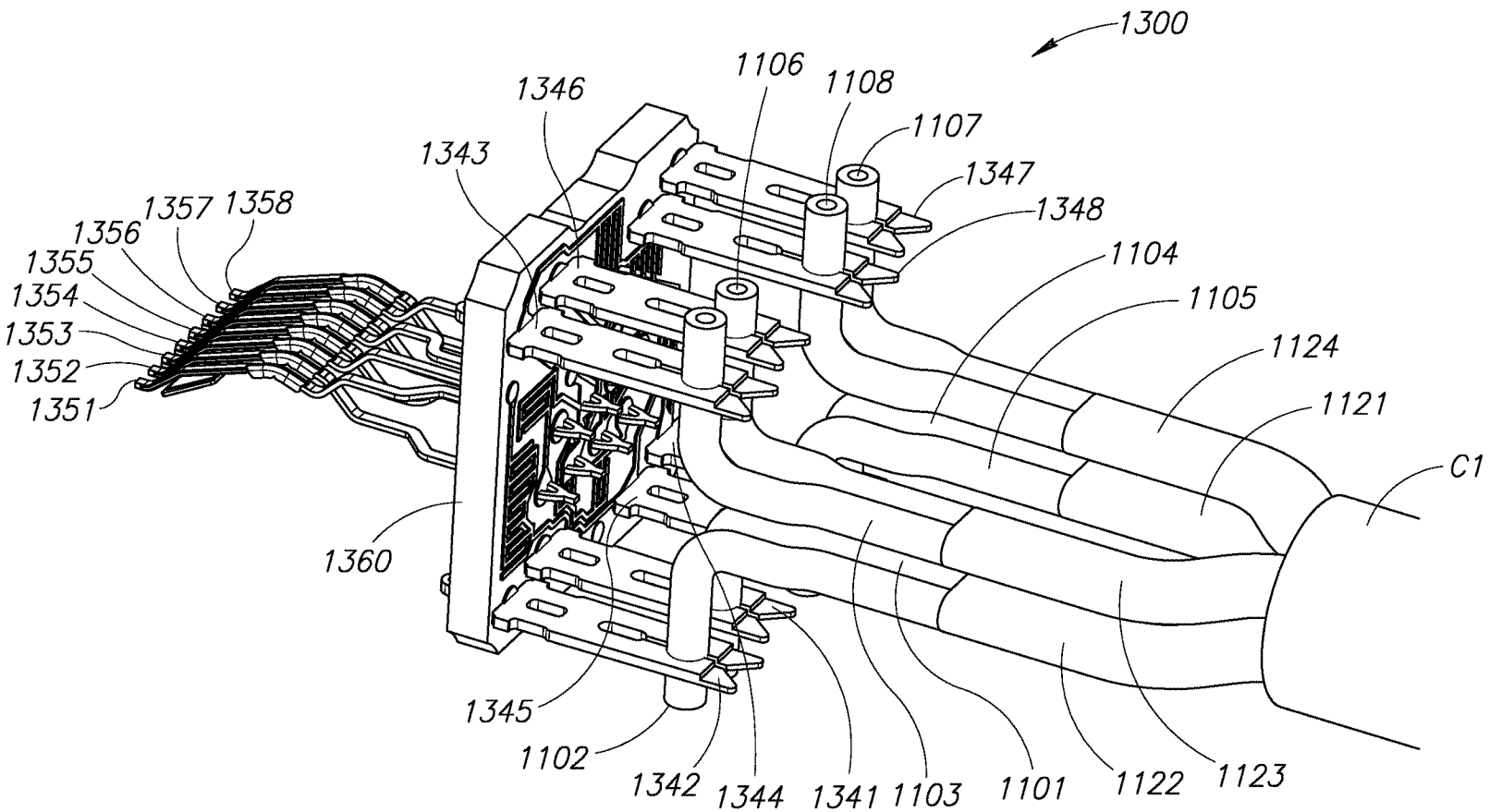
FIG. 12 is an enlarged perspective view of four wire pairs connected to the outlet.

FIG. 10 is an enlarged perspective view of the connection 1200 in which both the terminal block 1320 and the body 1330 have been removed from the outlet 1300, and the housing 1010 (see FIGS. 1 and 2) has been removed from the reinstated shield assembly 1000. FIG. 11 is an enlarged perspective view of the cable "C1," the reinstated shield assembly 1000 with the housing 1010 (see FIGS. 1 and 2) removed, and the outlet 1300 with the body 1330 removed. FIG. 12 is an enlarged perspective view of the wire pairs "P1" to "P4" connected to the outlet 1300. The reinstated shield assembly 1000 has been omitted from FIG. 12 to provide a better view of the wire pairs "P1" to "P4" and pair shields 1121-1124 of the cable "C1."

Turning to FIG. 10, as mentioned above, the wire pairs "P1" to "P4" each extend outwardly from the front of the subassembly 1040 to be coupled to the outlet 1300. By way of a non-limiting example, the outlet 1300 may be implemented as a shield RJ-45 type jack. The reinstated shield assembly 1000 does not require any accuracy on the part of a person terminating the cable "C1" to the outlet 1300. This allows for simple and/or crude and thus rapid removal of the pair shields 1121-1124 (see FIG. 12) by any means, including tearing and/or ripping the pair shields against a sharp and/or serrated edge. The reinstated shield assembly 1000 helps maintain (or extend) the shielding provided by the pair shields 1121-1124 (see FIG. 12) up to a location adjacent to the wire connectors 1341-1348 (which are the termination points whereat the cable "C1" is connected to the outlet 1300). The wire connectors 1341-1348 have been illustrated as conventional fork-shaped insulation displacement connectors ("IDCs"). However, this is not a requirement. Other types of wire connectors (including those described below)

may be used to terminate the wire pairs "P1" to "P4" to the outlet 1300 or another communications connector.

As shown in FIG. 10, the wires 1101-1108 are connected to the wire connectors 1341-1348, respectively. The first electrically conductive member 1030 extends the shielding provided by the pair shields 1122 and 1123 toward the wire connectors 1341, 1342, 1343, and 1346. The second electrically conductive member 1032 extends the shielding provided by the pair shields 1122 and 1123 (see FIG. 11) toward the wire connectors 1344, 1345, 1347, and 1348.

Turning to FIG. 12, the outlet 1300 includes at least one substrate 1360 (depicted as a printed circuit board) configured to connect the wire connectors 1341-1348 with the outlet contacts 1351-1358, respectively. As mentioned above, the outlet contacts 1351-1358 are positioned to make contact with the plug contacts (not shown) of the plug 1310 (see FIGS. 9 and 10) when the plug is received by the body 1330 (see FIG. 9). Thus, the wires 1101-1108 of the cable "C1" are connected to corresponding wires (not shown) of the cable "C2" (see FIG. 9).

Turning to FIG. 10, after the wires 1101-1108 are connected to the wire connectors 1341-1348, respectively, the reinstated shield assembly 1000 may be slid along the wires 1101-1108 toward the wire connectors 1341-1348 to reinstate the shield to as close to the wire connectors 1341-1348 as possible.

Returning to FIG. 6, end portions of the loops "L1" to "L4" at the front portion 1060 of the compressible member 1020 may be characterized as being "precisely located reinstated ends" of the new reinstated shield (which in this embodiment includes the first and second electrically conductive members 1030 and 1032). Such reinstated ends may be connected to a conductive body portion (not shown) of a communications connector. The reinstated ends may be configured such that when they engage the conductive body portion of the communication connector a desired characteristic impedance is maintained across the connection.

While the pair shields 1121-1124 may physically contact the loops "L1" to "L4," respectively, in some implementations, one or more of the pair shields 1121-1124 may be removed at a location outside the loops "L1" to "L4," respectively. In such embodiments, each of the loops "L1" to "L4" that surrounds an unshielded one of the wire pairs "P1" to "P4" may act as a replacement pair shield (instead of an extension of the pair shield). For example, the replacement pair shield may capacitively couple with the wire pair.

Referring to FIG. 2, the housing 1010 (or a similar structure configured to compress the subassembly 1040) may be incorporated into a communications connector (not shown). In such embodiments, the first housing portion 1050 may be incorporated into a first housing or body portion (not shown) of the communication connector (not shown), and the second housing portion 1052 may be incorporated into a second housing or body portion (not shown) of the communication connector (not shown).

Wire Connectors

A transmission line may have a first end opposite a second end. The second end may be attached to a load and referred to as a "load" end. The first end may be connected to a signal source. If the transmission line has constant impedance along its length, the transmission line will not reflect signals. Such a transmission line delivers signals (launched on its first end) to the "load" end. If the load has the same impedance as the transmission line, the system may be characterized as being reflection free. A differential transmission line includes a twisted pair of wires. Each of the wires includes a conductor typically surrounded by an insulating wire jacket.

For a differential transmission line that includes a twisted pair of identical wires, the characteristic impedance is described by the following equation.

$$Z_0(ohms) = \frac{120}{\sqrt{\varepsilon_r}} \cdot \ln\left[\frac{2s}{d}\right]$$

In the above equation, a variable "$Z_o$" represents the characteristic impedance of the twisted wire pair, and a variable "$\in_r$" represents a relative dielectric constant of any materials surrounding the conductors of the wires (e.g., insulating wire jackets, air, and the like). Because the value of the variable "$\in_r$" and the other values in the equation are constants, the impedance may vary along the differential transmission line based only on the values of the variable "s," which is the spacing between centers of the conductors of the wires, and the variable "d," which is the diameter of the conductors in the wires. Thus, for a differential transmission line including the twisted wire pair to have an invariant characteristic impedance along its length, a ratio of the variable "s" to the variable "d" (the "s/d ratio") must be invariant (or constant).

In practical transmission systems, the differential transmission line is terminated at a connector. Ideally, the value of the variable "s" and the value of the variable "d" would not change at the connector. However, unless the connector is welded and machined such that the relative dielectric constant is reinstated, and any electrical/geometric changes nearby are maintained, there will be an impedance discontinuity at the connector, and thus, a reflection. If the length of this discontinuity is significantly shorter than the shortest wavelength transmitted by the differential transmission line, the discontinuity (high impedance or low impedance) will essentially go undetected because the low-to-high reflection and the high-to-low reflection at each end of the short discontinuity will cancel each other.

As bandwidth needs increase, frequencies transmitted increase, and the wavelengths become shorter. Reflections at either end of the discontinuity are no longer close enough together to be 180 degrees (or PI radians) out of phase, thus the low-to-high reflection and the high-to-low reflection will not cancel one another sufficiently to go unnoticed. Therefore, the system becomes vulnerable to shorter and shorter discontinuities and more care needs to be taken to match the values of the variables "s," "d," and "$\in_r$."

If the connector to which the wires are connected includes two identical metal wire connectors, a change in impedance may occur at the wire connectors. If the size of the wire connectors approximates the value of the variable "d," the wire connectors may be spaced apart by the value of the variable "s." In other words, when the size of the wire connectors approximates the value of the variable "d," the spacing of the wire connectors does not need to compensate for a larger or smaller diameter conductor. On the other hand, when the size of the wire connectors varies significantly from the value of the variable "d," the spacing of the wire connectors needs to compensate for change in size. For example, if the wire connectors are significantly larger than the value of the variable "d," the spacing between the wire connectors must be larger than the value of the variable "s" to maintain an impedance within the connector that reasonably matches the characteristic impedance of the transmission line (represented by the variable "$Z_o$"). Such changes in spacing need to be made gradually (which requires extra length) to avoid impedance "lumps" and provide good return loss. Wire connectors with these features perform better at higher frequencies, or at greater bandwidths. Thus, more data (or in the case of high power transmitters, more energy) is delivered and not reflected back to the source.

Traditional fork-shaped insulation displacement connectors (e.g., 110 style insulation displacement connectors) exhibit not only a tremendous metal cross-section change, but also require the two wires in the pair be separated. This separation, if wide and near something susceptible or emissive, will allow electronic fields to extend far enough to cause unwanted coupling. Such unwanted coupling often occurs with other wire pairs and/or circuits in the same connector. This separation may also occur over a considerable longitudinal distance, which causes the impedance to rise as the value of the variable "s" increases. When the huge fork-shaped insulation displacement connectors are encountered, the change in the s/d ratio usually causes the impedance to drop below the desired characteristic impedance of the transmission line.

The wire connectors illustrated in FIGS. 13-17, 19-21, and 24-37 may be characterized as being insulation displacement connectors. Each of these wire connectors may be used to connect (or terminate) a wire (e.g., a wire "W-A" illustrated in FIG. 13) to an electrical component (e.g., a circuit). Each of these wire connectors is configured to function in a manner similar to a conventional insulation displacement connector ("IDC") (e.g., a 110 style IDC) but provide improved impedance matching between the wire and the electrical component (e.g., a circuit). A pair of these wire connectors may be used to connect a pair of wires (e.g., a twisted pair) to an electrical component (e.g., a circuit). These wire connectors may be smaller than a conventional IDC, and therefore, more suitable for use in smaller form factor connectors (such as solderless versions of SFP and QSFP connectors and any solderless version of narrow pitch connectors that are generally narrower than the pitch of common '110' style connections used in the telecommunications industry). These wire connectors may also be used with high-frequency copper (transverse electric and magnetic mode) balanced transmission lines and connectors. Each of the wire connectors may be configured to resist the wire (e.g., a wire "W-A" illustrated in FIG. 13) being pulled (or yanked) or otherwise separated from the wire connector. Thus, the wire connectors may provide yank-abuse tolerant wire terminations.

The wire connectors depicted in FIGS. 13-17, 19-21, and 24-37 are each configured to be less electrically intrusive than conventional fork-shaped insulation displacement connectors. The phrase "less electrically intrusive" means that a significant change in characteristic impedance does not occur at the wire connectors. As explained above, it is desirable for a pair of wire connectors to each have a size that approximates the diameter of the wires in a twisted wire pair so that the wire connectors may be spaced apart by approximately the same amount by which the wires are spaced apart. Such an arrangement helps maintain the same characteristic impedance at the wire connectors that exists in the twisted wire pair. Thus, the wire connectors depicted in FIGS. 13-17, 19-21, and 24-37 have smaller lateral sizes than conventional insulation displacement connectors. The smaller lateral size reduces radiated noise and/or received noise. In other words, the wire connectors may be configured to provide smaller changes in the value of the variable "s." If desired, these wire connectors may be configured to have short lengths.

The wire connectors depicted in FIGS. 13-17, 19-21, and 24-37 are oriented longitudinally alongside the wire connected to the wire connector. In other words, the wire connectors depicted in FIGS. 13-17, 19-21, and 24-37 are each oriented substantially parallel to the wire the wire connector terminates. This arrangement allows the wire connectors to hug the signal wires.

First Embodiment

Figure 13:
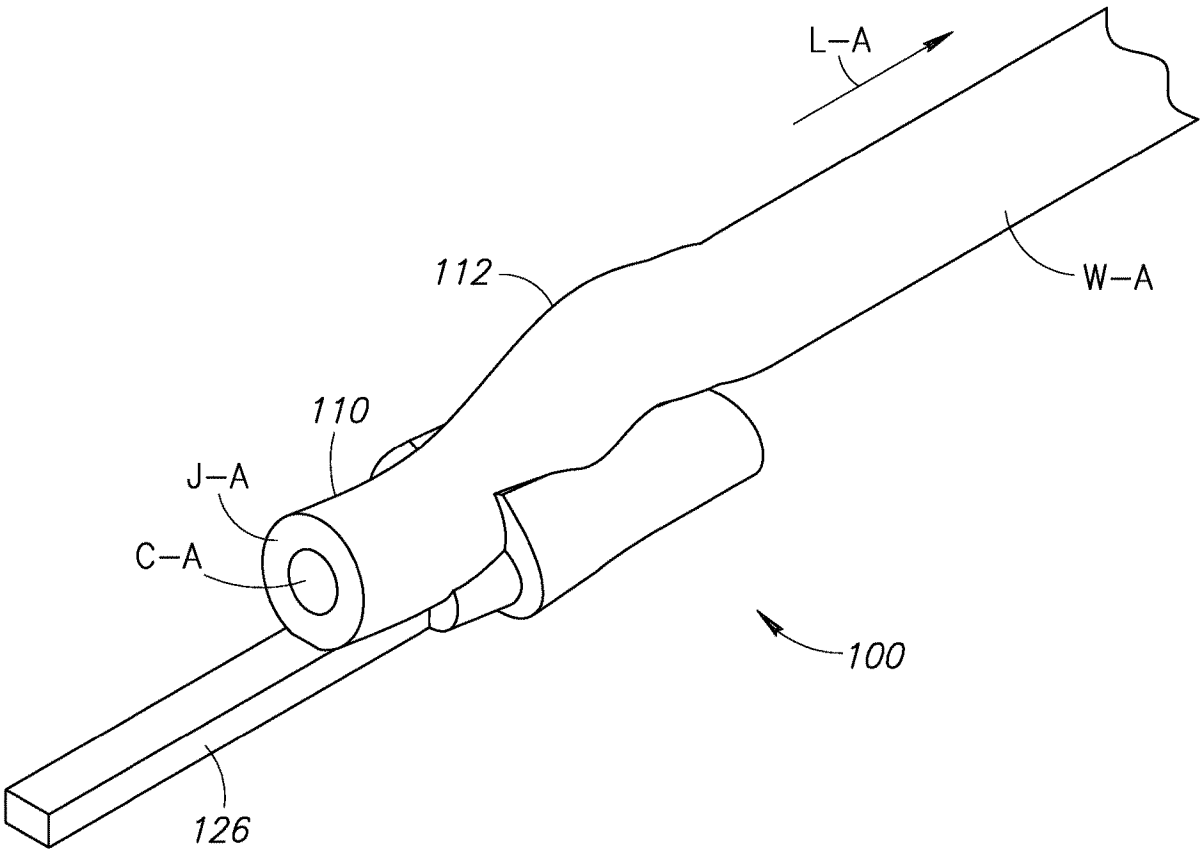
FIG. 13 is a perspective view of a wire terminated by a first embodiment of a wire connector.

FIG. 13 is a perspective view of the wire "W-A" terminated by a first embodiment of a wire connector 100. The wire "W-A" may be one wire of a wire pair configured to conduct a differential signal. Further, the wire "W-A" may be one wire of a plurality of wires incorporated into a cable (e.g., the cable "C3" illustrated in FIG. 16). The wire "W-A" includes a conductor "C-A" surrounded circumferentially by an insulating jacket "J-A" (e.g., plastic insulation). The conductor "C-A" may include stranded conductors, a solid conductor (e.g., a conventional copper wire), and the like. The wire "W-A" has a free distal end 110 connected to a wire body portion 112 adjacent the wire connector 100. The wire body portion 112 may extend into a cable and/or be attached to a signal source (not shown). The wire body portion 112 is elongated and extends longitudinally from the free distal end 110 in a longitudinal direction identified by an arrow "L-A."

Figure 14:
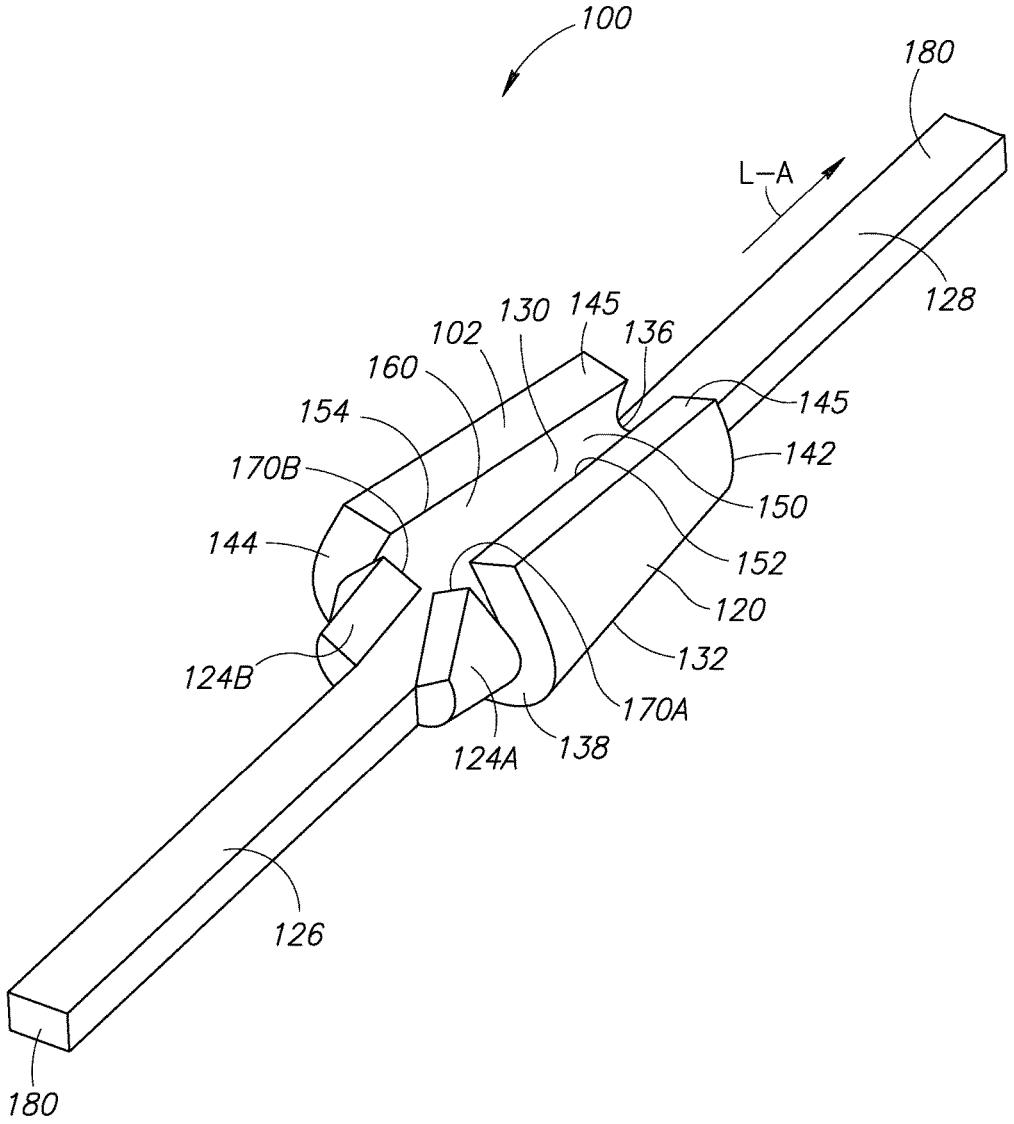
FIG. 14 is a perspective view of a wire receiving side of the wire connector of FIG. 13.

FIG. 14 is a perspective view of a wire receiving side 102 of the wire connector 100. The wire connector 100 is constructed from a substantially conductive material (e.g., brass, phosphor bronze, steel, beryllium copper, and the like). The wire connector 100 has a body portion 120, optional tabs 124A and 124B, and one or more contact projections 126 and 128.

Turning to FIG. 13, while conventional IDCs (see e.g., the wire connectors 1341-1348 depicted in FIGS. 10 and 12) are substantially orthogonal to a conductor in a wire, the wire connector 100 extends alongside the conductor "C-A" of the wire "W-A." Thus, the wire connector 100 extends longitudinally along the direction identified by the arrow "L-A." Further, the wire connector 100 conducts the signal transmitted by the wire "W-A" in substantially the same longitudinal direction that the wire "W-A" conducts the signal.

Figure 15:
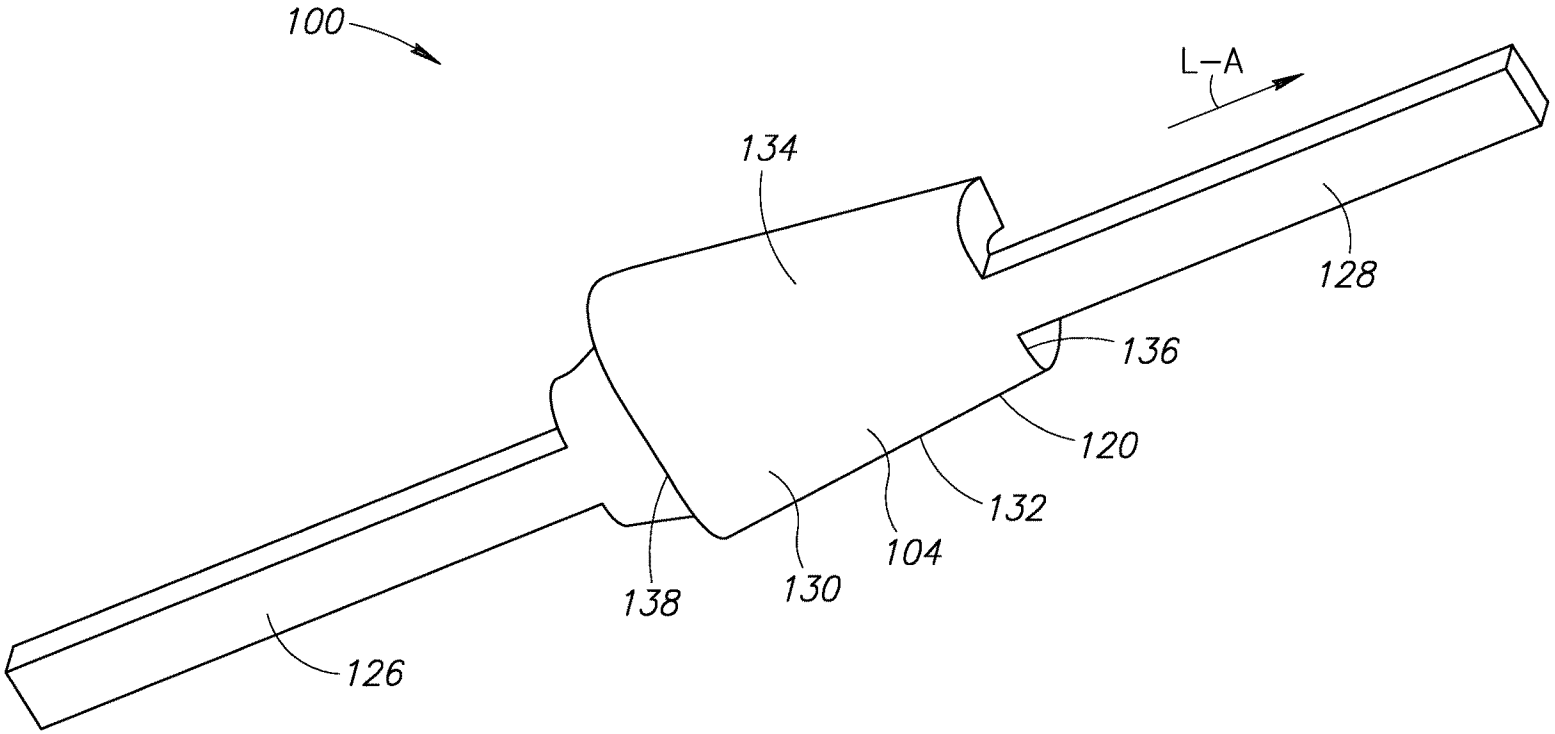
FIG. 15 is a perspective view of an underside of the first embodiment of the wire connector opposite the wire receiving side depicted in FIG. 14.

The body portion 120 is configured to cut through the insulating jacket "J-A" to contact the conductor "C-A." FIG. 15 is a perspective view of an underside 104 of the wire connector 100 opposite the wire receiving side 102 (see FIG. 14) of the wire connector 100. The body portion 120 tapers longitudinally. Thus, the body portion 120 may be generally frustoconical in shape. The body portion 120 has a longitudinally extending base portion 130 having a first side portion 132 opposite a second side portion 134. The base portion 130 also includes a front portion 136 opposite a back portion 138.

Returning to FIG. 14, a first curved sidewall 142 extends between the front and back portions 136 and 138, and away from the first side portion 132 of the base portion 130. A second curved sidewall 144 extends between the front and back portions 136 and 138, and away from the second side portion 134 (see FIG. 15) of the base portion 130. The first and second curved sidewalls 142 and 144 each has a back portion 145 adjacent the back portion 138 of the base portion 130.

The first and second curved sidewalls 142 and 144 extend partway toward one another. A longitudinally extending tapered gap 150 is defined between a distal edge portion 152 of the first curved sidewall 142 and a distal edge portion 154 of the second curved sidewall 144. A tapered wire receptacle 160 is defined between the base portion 130 and the sidewalls 142 and 144. Both the gap 150 and the wire receptacle 160 are wider near the back portion 138 of the base portion 130 than they are near the front portion of the base portion 130.

The optional tabs 124A and 124B extend away from the base portion 130 alongside the sidewalls 142 and 144, respectively. While the optional tabs 124A and 124B have been illustrated as being positioned near the back portion 138 of the base portion 130, this is not a requirement. For example, in alternate embodiments, one or more of the optional tabs 124A and 124B may be positioned near the front portion 136 of the base portion 130. In the embodiment illustrated, the tabs 124A and 124B are tapered, having pointed distal end portions 170A and 170B, respectively. The pointed distal end portions 170A and 170B are configured to pierce the insulating jacket "J-A" (see FIG. 13) of the wire "W-A" (see FIG. 13).

The wire "W-A" (see FIG. 13) may be placed adjacent the gap 150 with the free distal end 110 near the back portion 138 of the base portion 130 of the wire connector 100. Then, the wire body portion 112 may be pressed into the wire receptacle 160 through the gap 150. When the wire "W-A" is pressed through the gap 150, at least one of the distal edge portions 152 and 154 of the wire connector 100 cuts through the insulating jacket "J-A" (and optionally cuts partially into the conductor "C-A") to form an electrical connection with the conductor "C-A." The electrical connection may be formed where the gap 150 is just wide enough to accommodate the conductor "C-A" and/or deform or cut into the conductor "C-A" to form a gas tight contact therewith.

Because the gap 150 and the wire receptacle 160 are tapered, the wire connector 100 may be used to terminate wires having different diameters. Further, the wire "W-A" may not pass through the entire length of the gap 150. Instead, a portion of the wire "W-A" near the front portion 136 of the base portion 130 may rest upon the distal edge portions 152 and 154 of the first and second sidewalls 142 and 144 adjacent the gap 150. However, this is not a requirement.

One or more of the optional tabs 124A and 124B may similarly cut through the insulating jacket "J-A" (and optionally cut partially into the conductor "C-A") to form an electrical connection with the conductor "C-A." The optional tabs 124A and 124B may become at least partially embedded in the insulating jacket "J-A" to help prevent longitudinal movement of the wire "W-A" with respect to the wire connector 100. Thus, the optional tabs 124A and 124B may provide some strain relief. The optional tabs 124A and 124B may also help limit the inward movement of the wire "W-A" into the wire receptacle 160.

Optionally, the first and second sidewalls 142 and 144 may be crushed or crimped to collapse a portion of the wire receptacle 160 and narrow the gap 150 so the distal edge portions 152 and 154 of the first and second sidewalls 142 and 144 exert a greater gripping force on the wire "W-A."

Optionally, the first and second sidewalls 142 and 144 may be flexible to provide wire pinch compliance and tolerance with respect to tensile overload and push back. The first and second sidewalls 142 and 144 may be suitably flexible to maintain contact with the conductor "C-A" when longitudinal shear forces are exerted by the wire "W-A" on the wire connector 100.

In the embodiment illustrated, the wire connector 100 includes the longitudinally extending contact projections 126 and 128. However, in alternate embodiments, one or both of the projections 126 and 128 may be omitted. For example, in FIG. 13, the contact projection 128 was removed from the wire connector 100 before the wire "W-A" was terminated at the wire connector 100.

Figure 34:
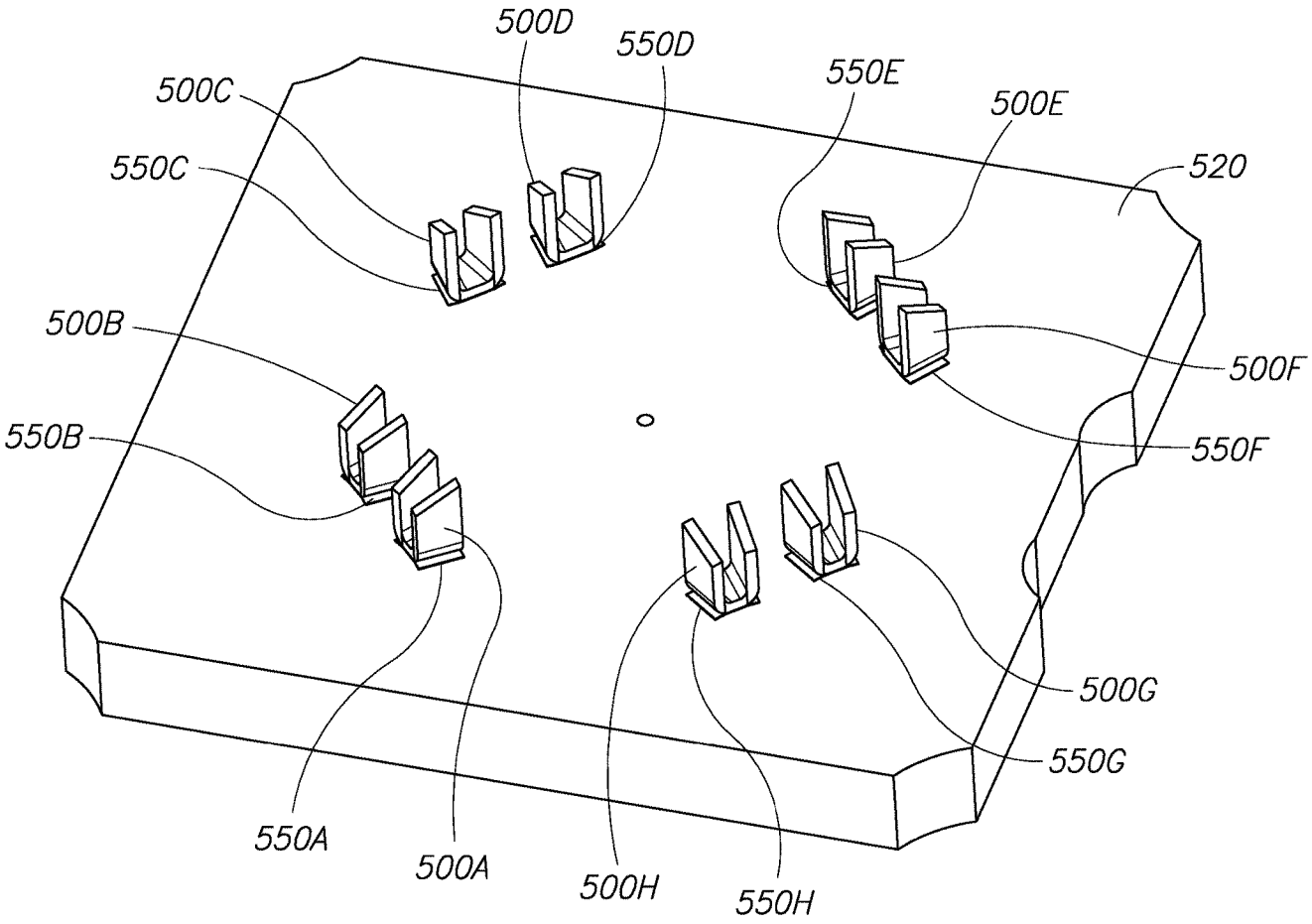
FIG. 34 is a perspective view of eight wire connectors each like the wire connector of FIG. 33 mounted on a PCB.

In embodiments in which the projections 126 and 128 have both been removed or omitted, the underside 104 (see FIG. 15) of the base portion 130 of the wire connector 100 may be surface mounted (e.g., soldered) to a contact (e.g., one of contacts 550A-550D depicted in FIG. 34).

Figure 16:
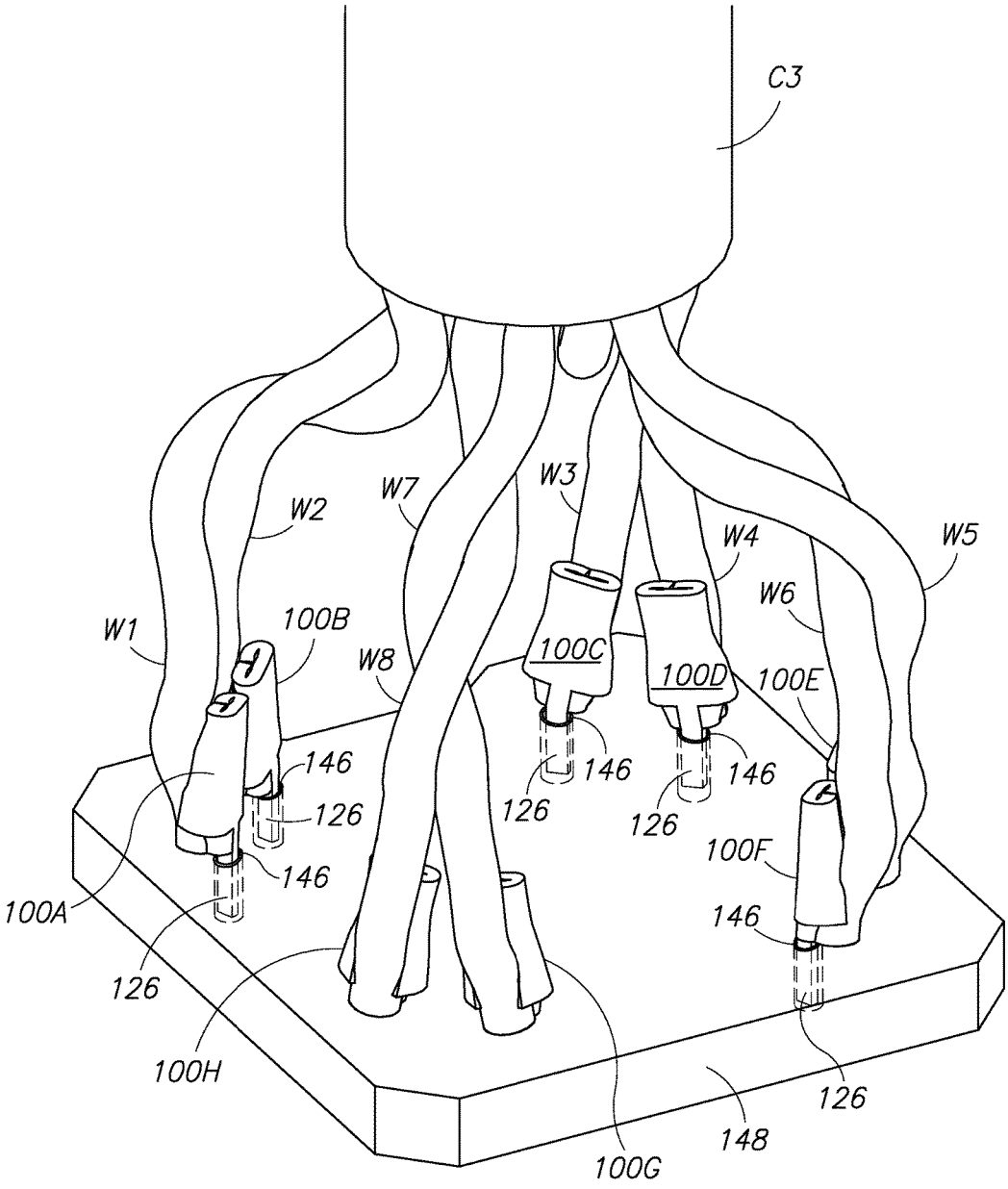
FIG. 16 is a perspective view of eight wire connectors each like the wire connector of FIG. 13 mounted on a PCB.

Each of the contact projections 126 and 128 has an end portion 180 that may be configured to be inserted into a plated through-hole (e.g., plated through-holes 146 illustrated in FIG. 4) formed in a printed circuit board (e.g., a printed circuit board ("PCB") 148 illustrated in FIG. 16). Optionally, each of the contact projections 126 and 128 may be bent such that they extend in substantially the same direction and each inserted into a different plated through-hole. For example, the contact projections 126 and 128 may be bent downwardly away from the wire receiving side 102 of the wire connector 100 before or after the wire "W-A" is terminated at the wire connector 100.

Figure 17:
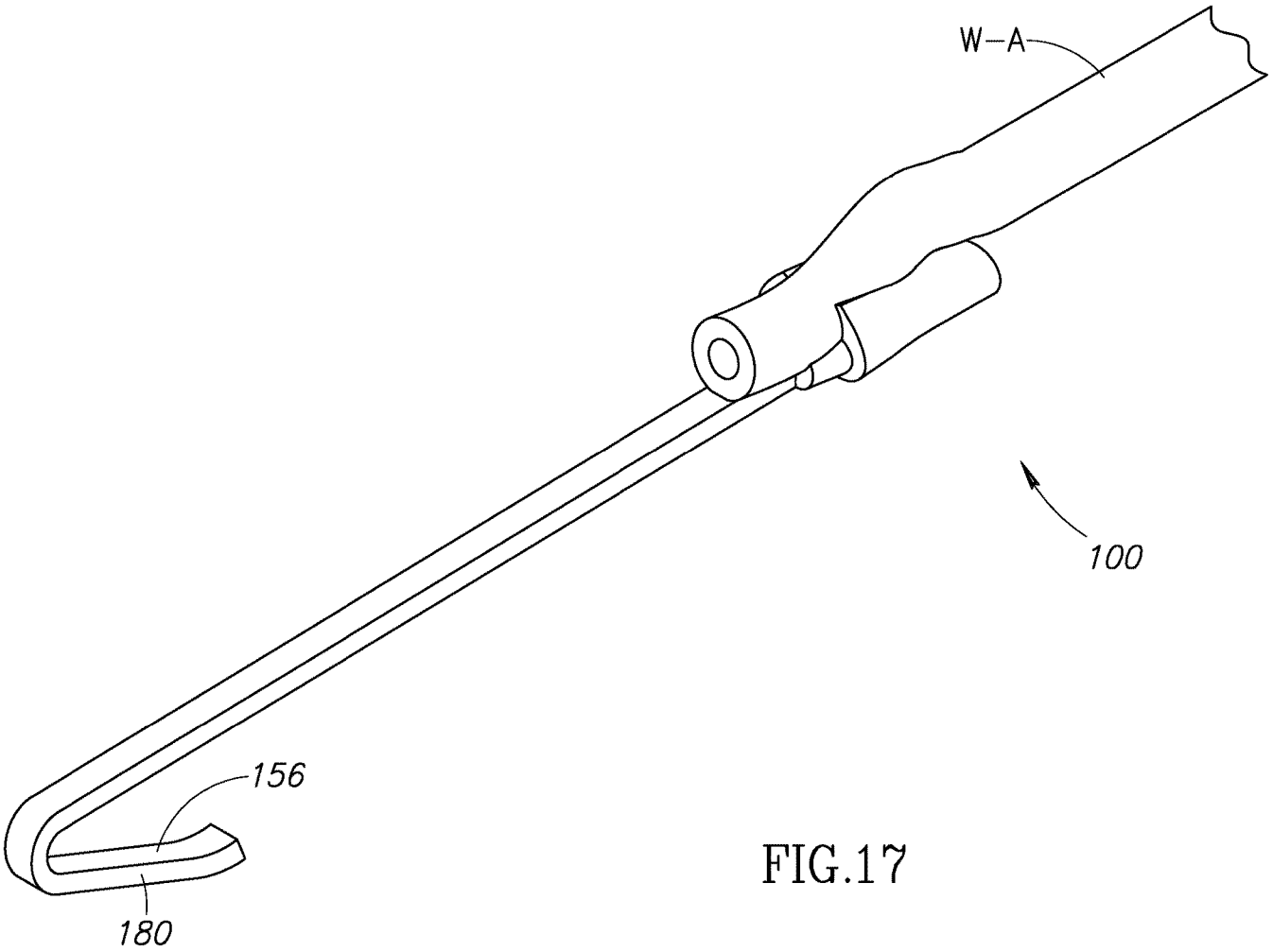
FIG. 17 is a perspective view of an alternate embodiment of the wire connector in which an outlet tine or contact is formed on an end portion of a contact projection.

Alternatively, referring to FIG. 17, an outlet tine or contact 156 may be formed in the end portion 180 of one of the contact projections 126 and 128. In such embodiments, the wire connector 100 may be incorporated into a communications connector (such as an outlet or plug). By way of a non-limiting example, the wire connector 100 may be incorporated into an RJ-45 type outlet or plug.

FIG. 16 is a perspective view of eight wire connectors 100A-100H mounted on the PCB 148. The wire connectors 100A-100H terminate wires W1-W8, respectively. The wires W1-W8 are components of the cable "C3." Each of the wires W1-W8 is substantially identical to the wire "W-A" (see FIG. 13). Each of the wire connectors 100A-100H is substantially identical to the wire connector 100 (see FIGS. 13-15). In the embodiment illustrated, each of the wire connectors 100A-100H omits the contact projection 128 (see FIGS. 14 and 15). The contact projections 126 of the wire connectors 100A-100H are received inside the plated through holes 146. Thus, the wire connectors 100A-100H form electrical connections between the wires W1-W8 and one or more circuits (not shown) on the PCB 148. In embodiment illustrated, the contact projections 126 of the wire connectors 100A-100H have been bent to position the wire connectors 100A-100H at desired angles with respect to the PCB 148 and/or one another.

Crimping Devices

Figure 18:
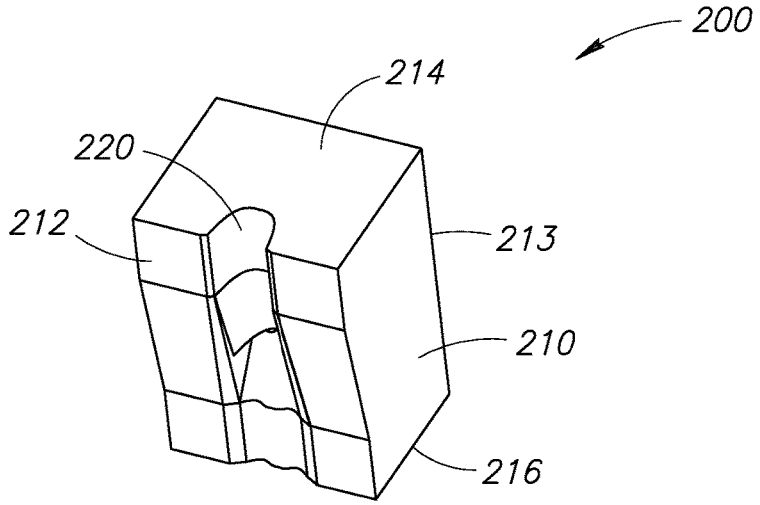
FIG. 18 is a perspective view of a first embodiment of a crimping device for use with the wire connector of FIG. 13.

FIG. 18 is a perspective view of a first embodiment of a crimping device 200 for use with the wire connector 100 (see FIGS. 13-15). The crimping device 200 has a body portion 210 with a lower portion 212 opposite an upper portion 213. The crimping device 200 also has a front portion 214 opposite a back portion 216. An open-ended cavity 220 is formed in the lower portion 212 and extends between the front and back portions 214 and 216.

Figure 19:
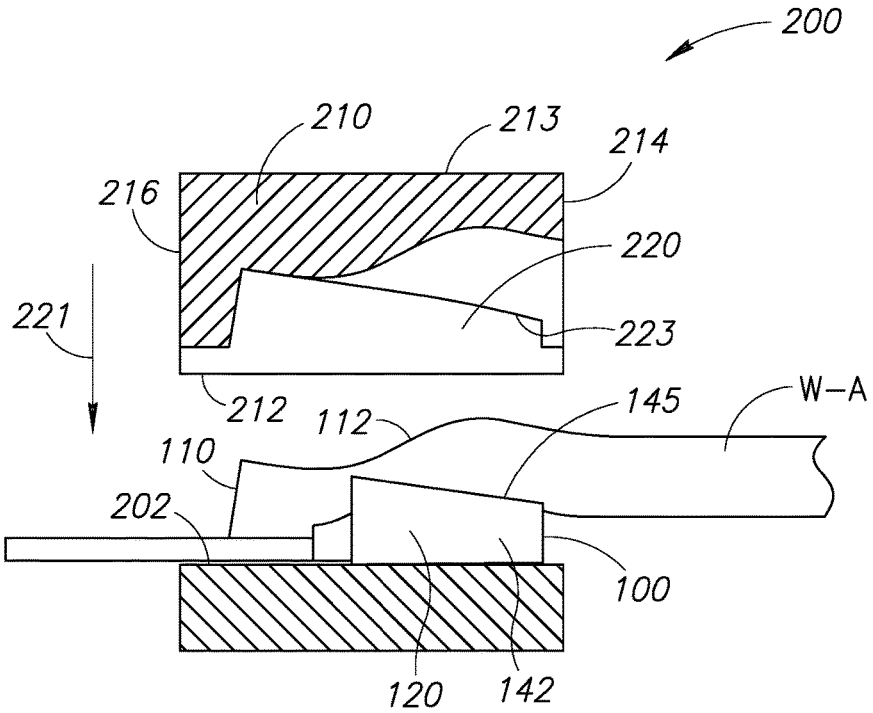
FIG. 19 is a side cross-section of the crimping device of FIG. 18 positioned above the wire connector of FIG. 13.

FIG. 19 depicts a side cross-section of the crimping device 200 positioned above the wire connector 100, which is resting upon a substantially planar support surface 202. In FIG. 19, the wire body portion 112 of the wire "W-A" has been pushed into the wire receptacle 160 (see FIG. 14) through the gap 150 (see FIG. 14). At least one of the distal edge portions 152 and 154 (see FIG. 14) has cut through the insulating jacket "J-A" (and optionally cuts partially into the conductor "C-A") to form an electrical connection with the conductor "C-A." The tabs 124A and 124B (see FIG. 14) have also cut through the insulating jacket "J-A" (and optionally cut partially into the conductor "C-A").

The open-ended cavity 220 is configured to receive the body portion 120 of the wire connector 100 when the crimping device 200 is lowered (in a direction indicated by arrow 221) onto the wire connector 100. However, a back portion 223 of the cavity 220 is shorter than the back portions 145 of the sidewalls 142 and 144 (see FIG. 14) of the body portion 120. Thus, when the crimping device 200 is lowered onto the wire connector 100 with sufficient force (in a direction indicated by the arrow 221), the back portion 223 of the cavity 220 smashes or crimps the back portions 145 of the sidewalls 142 and 144 (see FIG. 14) of the body portion 120.

Figure 20:
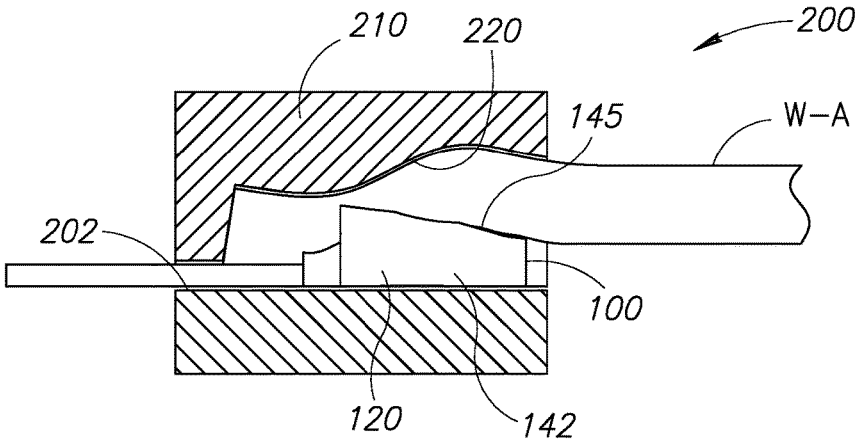
FIG. 20 is a side cross-section of the crimping device of FIG. 18 with the wire connector of FIG. 13 received fully inside an open-ended cavity of the crimping device and crimped thereby.

FIG. 20 depicts a side cross-section of the crimping device 200 with the wire connector 100 received fully inside the open-ended cavity 220 of the crimping device 200 and crimped thereby. When crimped in this manner, the back portions 145 of the sidewalls 142 and 144 are folded inwardly into the wire receptacle 160 (under the wire "W-A") and rest upon the base portion 130. Crimping forces the sidewalls 142 and 144 toward one another, narrowing the gap 150 (see FIG. 14) and exerting greater lateral force on the wire "W-A" to thereby increase the grip of the wire connector 100 on the wire "W-A."

Figure 21:
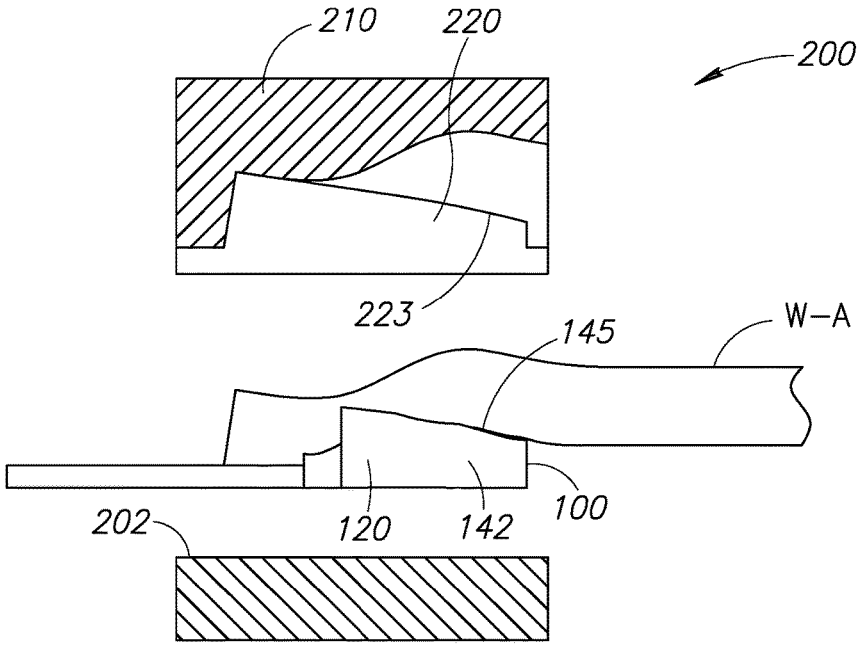
FIG. 21 is a side cross-section of the crimping device of FIG. 18 separated from the crimped wire connector of FIG. 20.

After the wire connector 100 has been crimped by the crimping device 200, the crimping device 200 may be separated from the wire connector 100. FIG. 21 depicts a side cross-section of the crimping device 200 separated from the crimped wire connector 100, which has been lifted from the support surface 202 and is ready to be used (e.g., inserted into one of the plated holes 146 depicted in FIG. 16).

Figure 22:
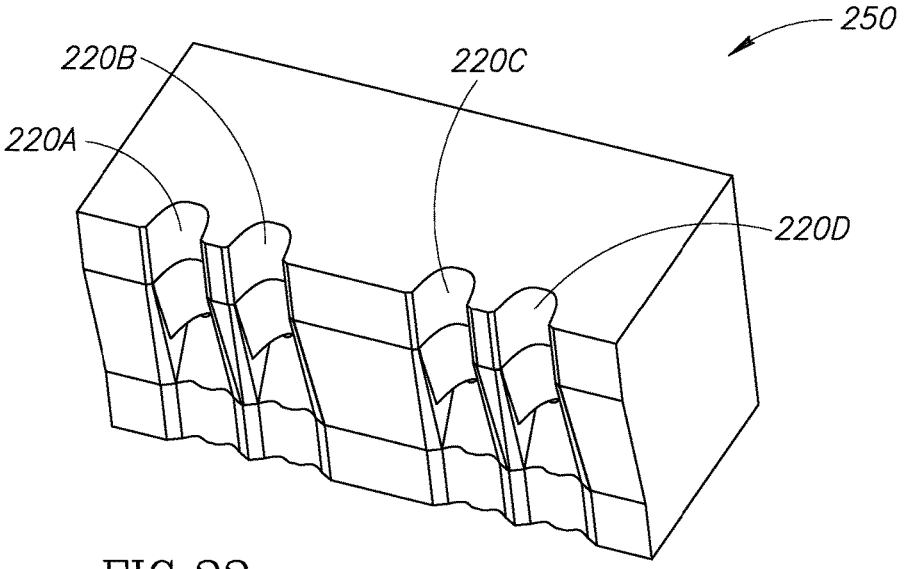
FIG. 22 is a first perspective view of a second embodiment of a crimping device.
Figure 23:
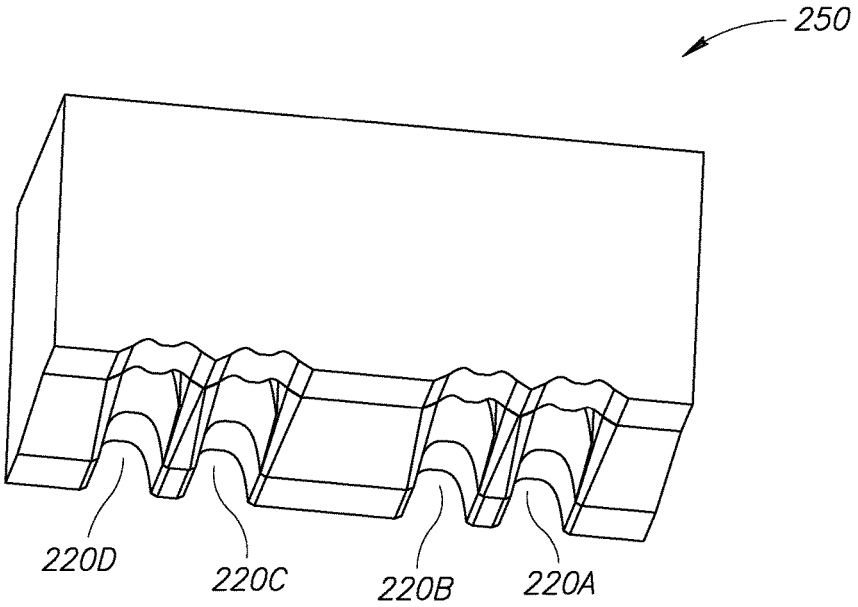
FIG. 23 is a second perspective view of the second embodiment of the crimping device.

FIGS. 22 and 23 are perspective views of a second embodiment of a crimping device 250. The crimping device 250 includes a plurality of spaced apart open-ended cavities 220A-220D each substantially identical to the open-ended cavity 220 (see FIGS. 18-21) of the crimping device 200. The crimping device 250 operates in substantially the same as the crimping device 200. However, the crimping device 250 is configured to crimp multiple wire connectors (each substantially identical to the wire connector 100 illustrated in FIGS. 13-15) at the same time.

Wire Manager

Figure 25:
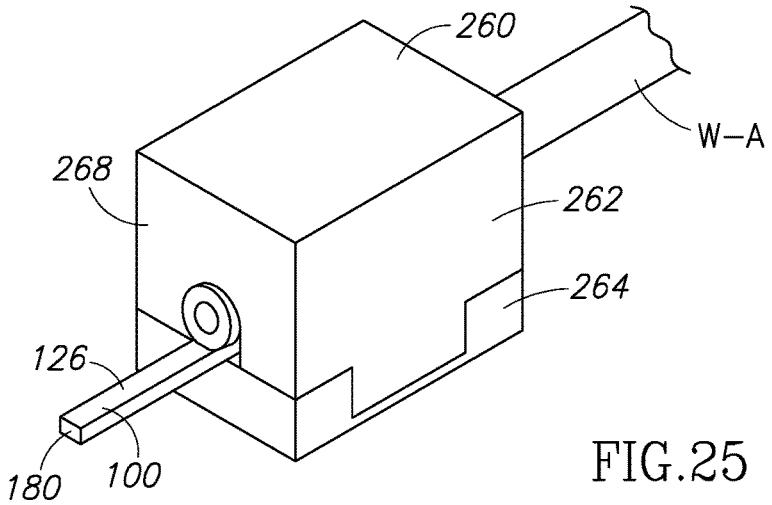
FIG. 25 is a perspective view of the wire manager of FIG. 24.

FIG. 25 is a perspective view of a first embodiment of a wire manager 260 for use with the wire connector 100 and the wire "W-A" terminated at the wire connector 100. The wire manager 260 includes an upper portion 262 and a lower portion 264.

Figure 24:
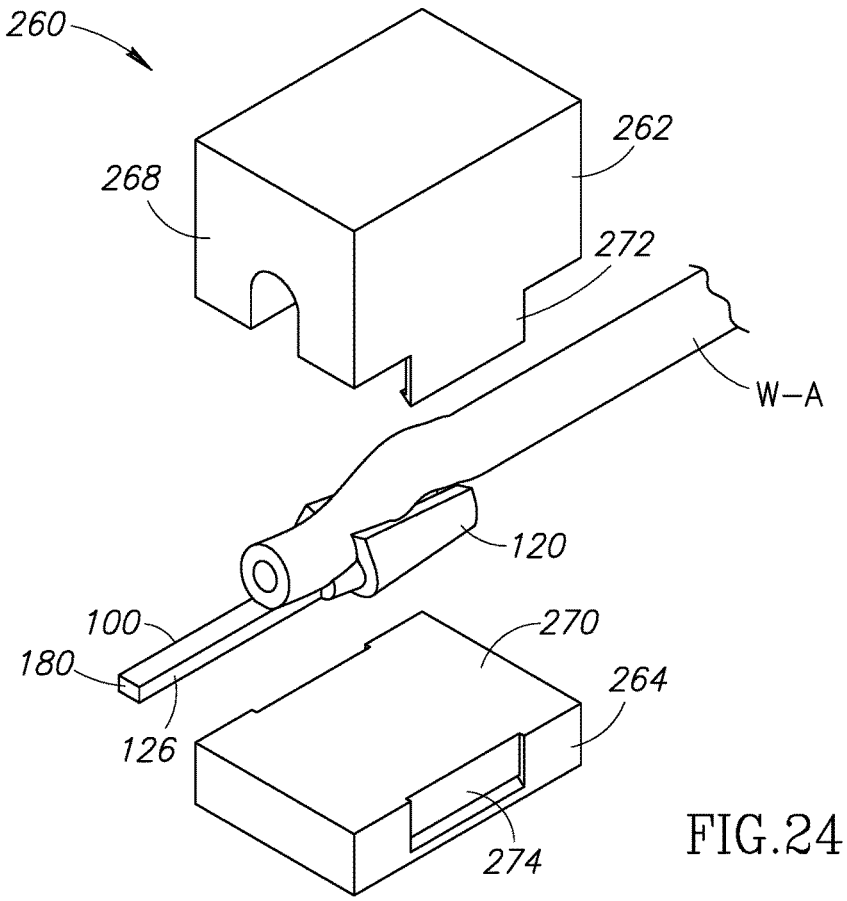
FIG. 24 is a partially exploded perspective view of a first embodiment of a wire manager for use with the wire connector of FIG. 13.

FIG. 24 is a partially exploded perspective view of the wire manager 260. In the embodiment illustrated, the upper and lower portions 262 and 264 are configured to snap together. The upper portion 262 has a body portion 268 that is substantially identical to the crimping device 200 (see FIGS. 18-21). The lower portion 264 has an upper support surface 270 that is substantially identical to the support surface 202 (see FIGS. 19-21). Thus, when the upper and lower portions 262 and 264 are assembled to form the wire manager 260, the upper and lower portions 262 and 264 crimp the wire connector 100 (which is illustrated in FIG. 24 before being crimped by the upper and lower portions 262 and 264).

In the embodiment illustrated, the upper portion 262 includes at least one connector 272 and the lower portion 264 includes at least one connector 274. The connectors 272 and 274 are configured to be mated together and when so mated, to permanently or removably lock the upper and lower portions 262 and 264 together.

When assembled together as shown in FIG. 25, the wire manager 260, the wire connector 100, and the wire "W-A" are ready for use (e.g., the end portion 180 of the contact projection 126 of the wire connector 100 may be inserted into one of the plated holes 146 illustrated in FIG. 16).

Figure 36:
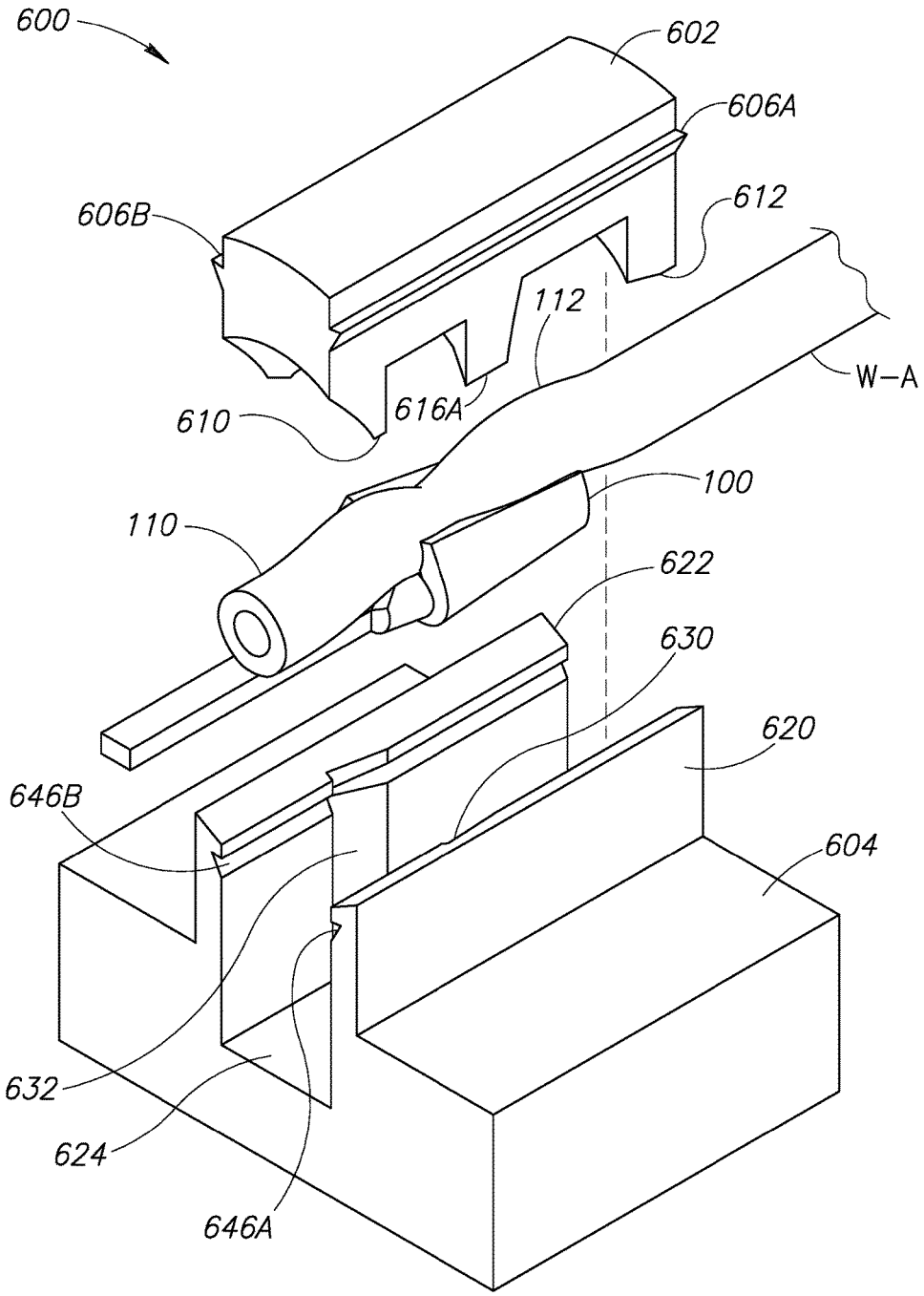
FIG. 36 is a partially exploded perspective view of a second embodiment of a wire manager for use with the wire connector of FIG. 13.
Figure 37:
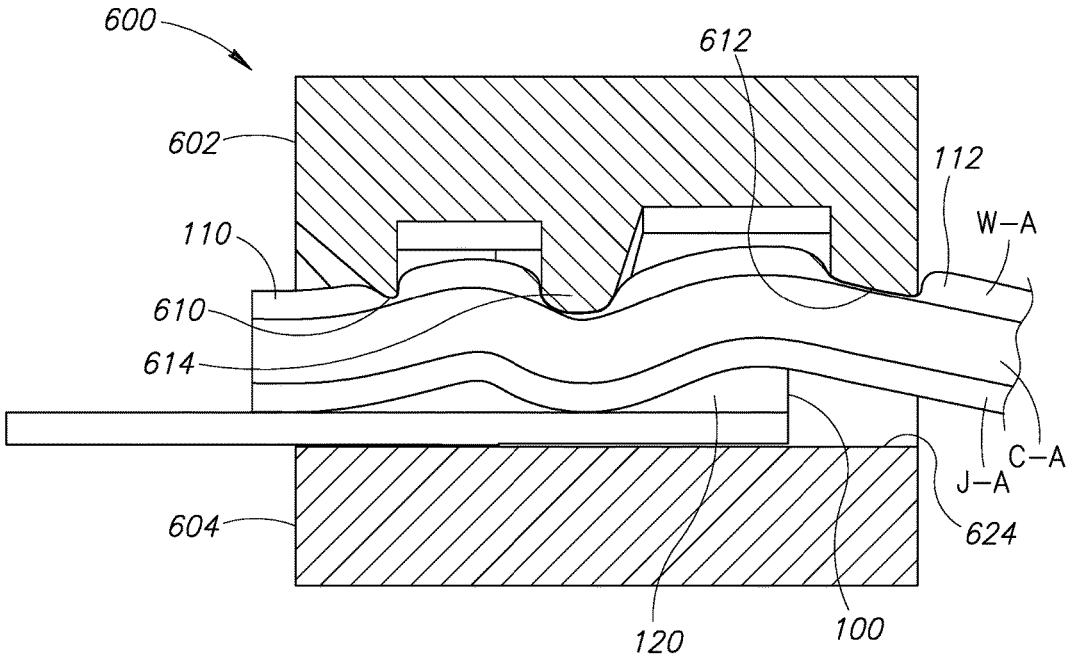
FIG. 37 is a longitudinal cross-section of the wire manager of FIG. 36 and the wire connector of FIG. 13.

FIG. 36 is a partially exploded perspective view of a second embodiment of a wire manager 600 for use with the wire connector 100 and the wire "W-A" terminated at the wire connector 100. Unlike the wire manager 260 illustrated in FIGS. 24 and 25, the wire manager 600 does not crimp the wire connector 100. FIG. 37 is a longitudinal cross-section of the wire manager 600, the wire connector 100, and the wire "W-A." Referring to FIGS. 36 and 37, the wire manager 600 includes an upper portion 602 and a lower portion 604. In the embodiment illustrated, the upper and lower portions 602 and 604 are configured to snap together.

Figure 38:
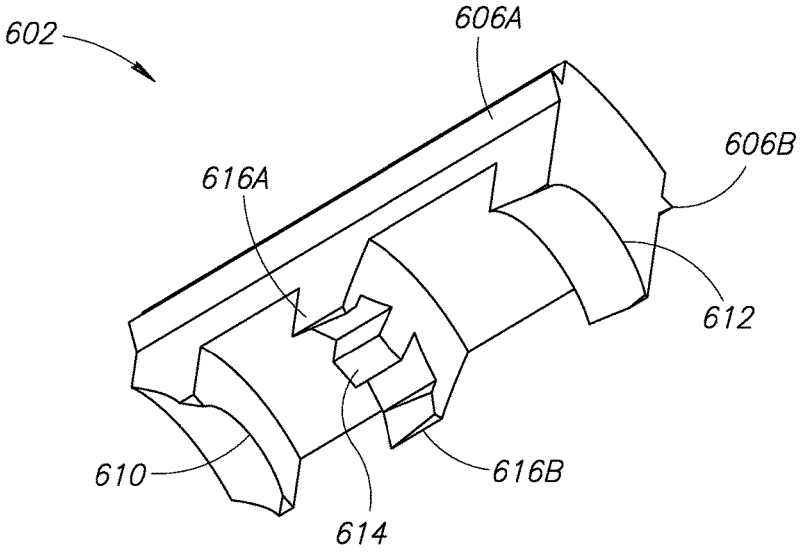
FIG. 38 is a perspective view of an underside of an upper portion of the wire manager of FIG. 36.

FIG. 38 is a perspective view of the underside of the upper portion 602. In the embodiment illustrated, the upper portion 602 includes connectors 606A and 606B configured to couple the upper portion 602 (permanently or removably) to the lower portion 604. The upper portion 602 includes a downwardly extending back projection 610 spaced apart longitudinally from a downwardly extending front projection 612. Referring to FIG. 37, the back projection 610 is positioned and configured to press into the insulating jacket "J-A" at the free distal end 110 of the wire "W-A" to help provide strain relief. Similarly, the front projection 612 is positioned and configured to press into the insulating jacket "J-A" at the wire body portion 112 of the wire "W-A" to help provide strain relief. The front and back projections 610 and 612 each compress and may optionally pierce the insulating jacket "J-A" of the wire "W-A."

Between the back and front projections 610 and 612, the upper portion 602 has a downwardly extending intermediate projection 614. The intermediate projection 614 is positioned to be adjacent the body portion 120 of the wire connector 100 (and the wire body portion 112 of the wire "W-A") when the wire manager 600 (see FIGS. 36 and 37) is assembled. The intermediate projection 614 presses the wire body portion 112 of the wire "W-A" into the wire receptacle 160 (see FIG. 14) through the gap 150 (see FIG. 14).

In the embodiment illustrated, the intermediate projection 614 is flanked on either side by tapered guide projections 616A and 616B. The guide projections 616A and 616B help center and position the wire connector 100 and/or the wire "W-A" with respect to the intermediate projection 614.

Figure 39:
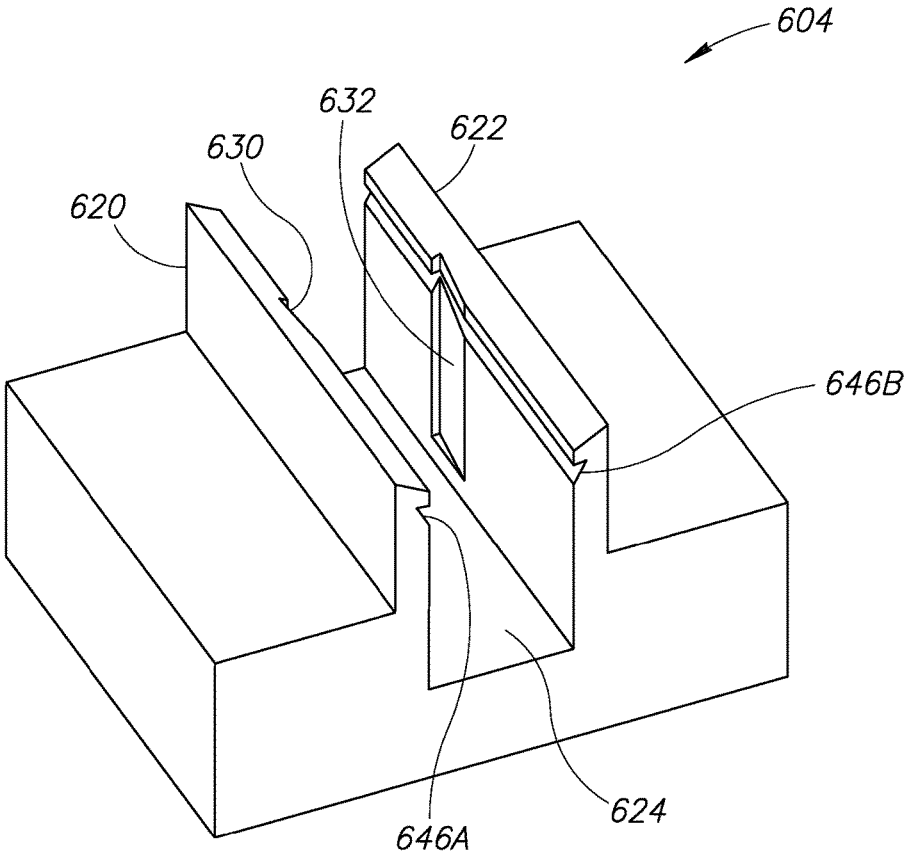
FIG. 39 is a perspective view of a top portion of a lower portion of the wire manager of FIG. 36.

FIG. 39 is a perspective view of the top portion of the lower portion 604. The lower portion 604 includes a first upright sidewall 620 spaced apart from a second upright sidewall 622. A support surface 624 extends between the first and second upright sidewalls 620 and 622. Optionally, grooves or channels 630 and 632 may be formed in the first and second upright sidewalls 620 and 622, respectively. The channels 630 and 632 allow the wire connector 100 to be received between the first and second upright sidewalls 620 and 622, respectively, and placed on the support surface 624. The channels 630 and 632 may be used to position the wire connector 100 longitudinally with respect to the intermediate projection 614 of the upper portion 602.

The first and second upright sidewalls 620 and 622 are adequately spaced apart so that the front, back, intermediate, and guide projections 610, 612, 614, 616A, and 6166 of the upper portion 602 may be received between the first and second upright sidewalls 620 and 622 to engage the wire "W-A" (see FIGS. 36 and 37) and/or the wire connector 100.

In the embodiment illustrated, the lower portion 604 includes connectors 646A and 646B configured to be coupled (permanently or removable) with the connectors 606A and 606B, respectively, of the upper portion 602. In this manner, the upper portion 602 and the lower portion 604 may be snapped together to assemble the wire manager 600.

The may be used to position the wire connector 100 longitudinally with respect to the intermediate projection 614 of the upper portion 602.

The assembly illustrated in FIG. 37 is assembled by placing the wire connector 100 between the first and second upright sidewalls 620 and 622 and in the channels 630 and 632. Then, the wire connector 100 is slid downwardly in the channels 630 and 632 onto the support surface 624 of the lower portion 604. Next, the wire "W-A" is placed adjacent to the gap 150 (see FIG. 14). Then, the upper portion 602 is positioned above the lower portion 604 with the front, back, intermediate, and guide projections 610, 612, 614, 616A, and 616B positioned between the first and second upright sidewalls 620 and 622. The upper portion 602 is pressed toward the lower portion 604 until the connectors 606A and 606B, of the upper portion 602 engage the connectors 646A and 646B, respectively, of the lower portion 604. When the upper portion 602 is pressed toward the lower portion 604, the guide projections 616A and 616B may help position the wire "W-A" to align with the gap 150 (see FIG. 14). The intermediate projection 614 presses the wire "W-A" through the gap 150 and into the wire receptacle 160. At the same time, the front and back projections 610 and 612 compress the insulating jacket "J-A" of the wire "W-A" to provide strain relief and help prevent the longitudinal disengagement of the wire "W-A" from the wire connector 100. Together, the upper and lower portions 602 and 604 help prevent the lateral disengagement of the wire "W-A" from the wire connector 100.

Second Embodiment

Figure 26:
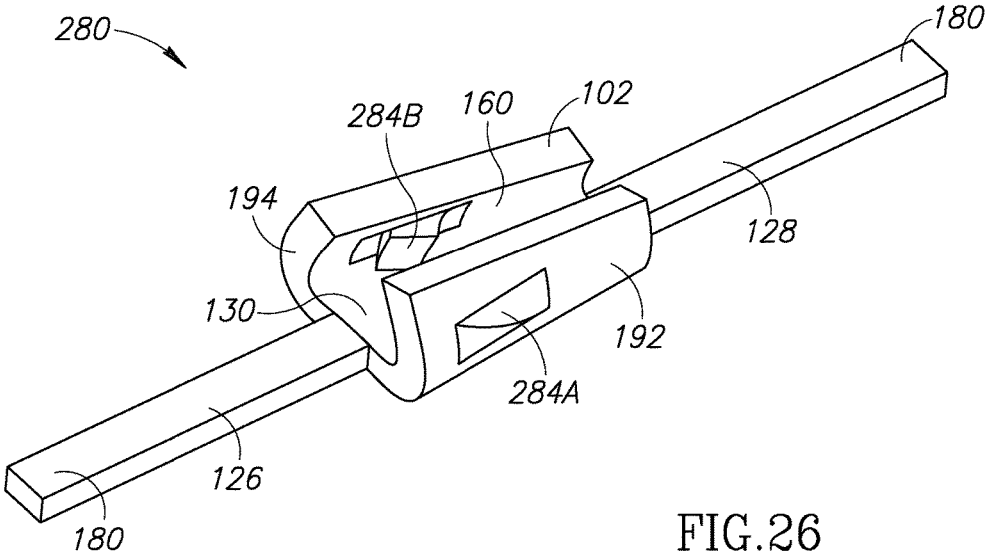
FIG. 26 is a perspective view of a wire receiving side of a second embodiment of a wire connector.
Figure 27:
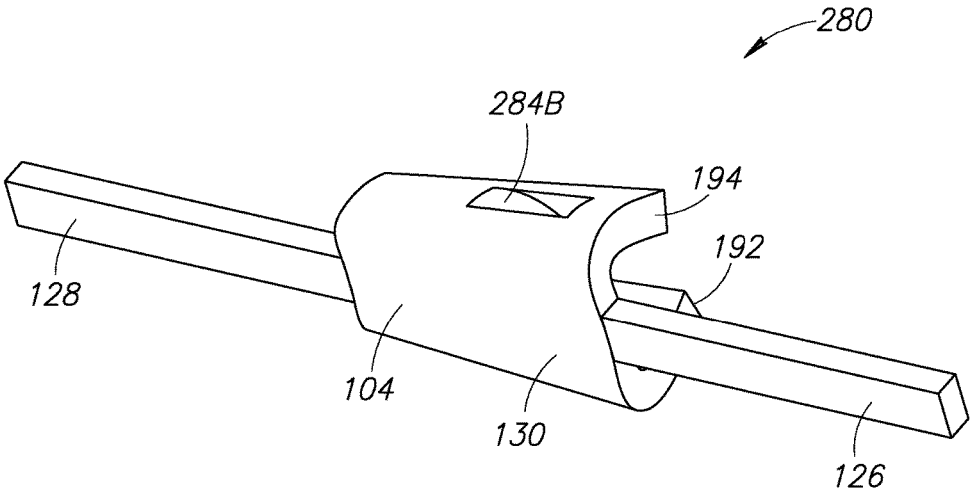
FIG. 27 is a perspective view of an underside of the wire connector of FIG. 26.

FIG. 26 is a perspective view of the wire receiving side 102 of a second embodiment of a wire connector 280. FIG. 27 is a perspective view of the underside 104 of the wire connector 280. Identical reference numerals have been used in FIGS. 13-15, 26, and 27 to identify like structures. The wire connector 280 may be used with the wire "W-A" depicted in FIGS. 13, 17, 19-21, 24, and 25. The wire connector 280 omits the optional tabs 124A and 124B (see FIG. 14). Instead, the wire connector 280 includes tabs 284A and 284B formed in sidewalls 292 and 294, respectively. The sidewalls 292 and 294 are substantially identical to the sidewalls 142 and 144, respectively, of the wire connector 100 except that the sidewalls 292 and 294 include the tabs 224A and 224B. By way of a non-limiting example, the tabs 284A and 284B may be cut into the sidewalls 292 and 294, respectively. The tabs 284A and 284B extend into the wire receptacle 160. The tabs 284A and 284B are each configured to compress and optionally pierce the insulating jacket "J-A" (see FIG. 13) of the wire "W-A" (see FIGS. 13, 17, 19-21, 24, and 25) when the wire "W-A" is inserted into the wire receptacle 160. The tabs 284A and 284B resist longitudinal movement of a wire (e.g., the wire "W-A" depicted in FIGS. 13, 17, 19-21, 24, and 25) relative to the wire connector 280. Optionally, the tabs 284A and 284B may cut into the conductor "C-A" but, this is not a requirement.

Optionally, the tabs 284A and 284B may be bent inwardly (as shown in FIGS. 26 and 27) after the wire "W-A" is inserted into the wire receptacle 160.

The wire connector 280 may be constructed from any material suitable for constructing the wire connector 100 (see FIGS. 13-15). Optionally, the wire connector 280 may be crimped (e.g., using the crimping device 200 illustrated in FIGS. 18-21, the crimping device 250 illustrated in FIGS. 22 and 23, or a similar crimping device). However, this is not a requirement. Optionally, the wire connector 280 may be used with a wire manager, such as the wire manager 260 illustrated in FIGS. 24 and 25, the wire manager 600 illustrated in FIGS. 36-39, and the like.

Third Embodiment

Figure 28:
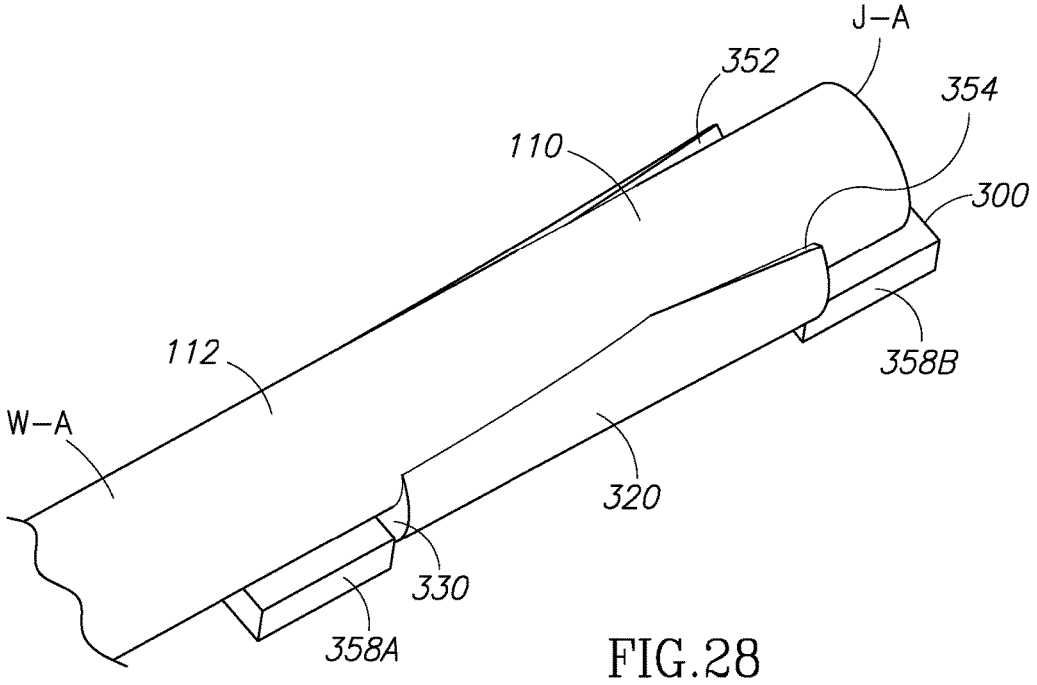
FIG. 28 is a perspective view of a third embodiment of a wire connector.

FIG. 28 is a perspective view of a third embodiment of a wire connector 300 terminating the wire "W-A." The wire connector 300 may be constructed from any material suitable for constructing the wire connector 100 (see FIGS. 13-15). Identical reference numerals have been used in FIGS. 13-15, and 26-29 to identify like structures.

Figure 29:
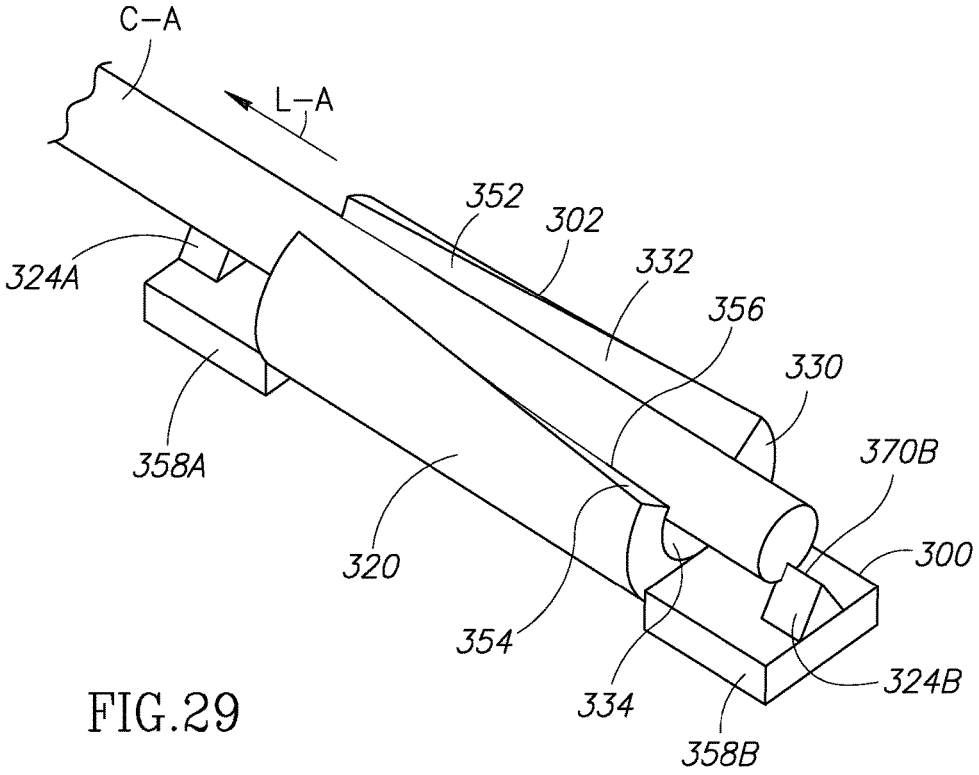
FIG. 29 is a perspective view of a wire receiving side of the wire connector of FIG. 28.

FIG. 29 is a perspective view of a wire receiving side 302 of the wire connector 300. In FIG. 29, the insulating jacket "J-A" (see FIG. 28) has been omitted to reveal the conductor "C-A" in the wire "W-A" (see FIG. 28). The wire connector 300 has a body portion 320, a front tab 324A, and a back tab 324B. The body portion 320 is configured to cut through the insulating jacket "J-A" (see FIG. 28) to contact the conductor "C-A." While a conventional IDC is substantially orthogonal to a conductor in a wire, the wire connector 300 extends alongside the conductor "C-A" of the wire "W-A." Thus, the wire connector 300 extends longitudinally in the direction identified by the arrow "L-A." Further, the wire connector 300 conducts the signal transmitted by the wire "W-A" in substantially the same longitudinal direction that the wire "W-A" conducts the signal.

Figure 30:
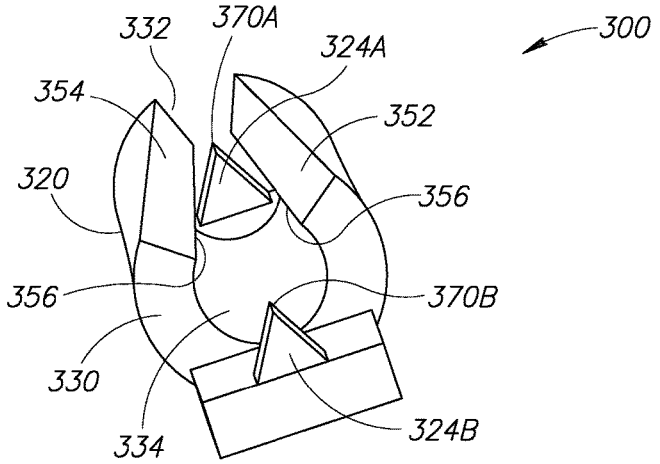
FIG. 30 is a perspective rear view of the wire connector of FIG. 28.

FIG. 30 is a perspective rear view of the wire connector 300. As may be seen in FIG. 30, the body portion 320 may include a discontinuous sidewall 330 that is generally cylindrical in shape. The sidewall 330 includes a longitudinally extending tapered gap 332 substantially similar to the gap 150 (see FIG. 14). The gap 332 is wider near the back tab 324B than near the front tab 324A.

The sidewall 330 defines a generally cylindrically shaped open-ended wire receptacle 334 that functions in a similar manner to the tapered wire receptacle 160 (see FIG. 14). The wire "W-A" may be inserted into the wire receptacle 334 through the gap 332. The sidewall 330 includes distal edge portions 352 and 354 that flank the gap 332. The distal edge portions 352 and 354 each have a sharp lower edge 356.

Figure 31:
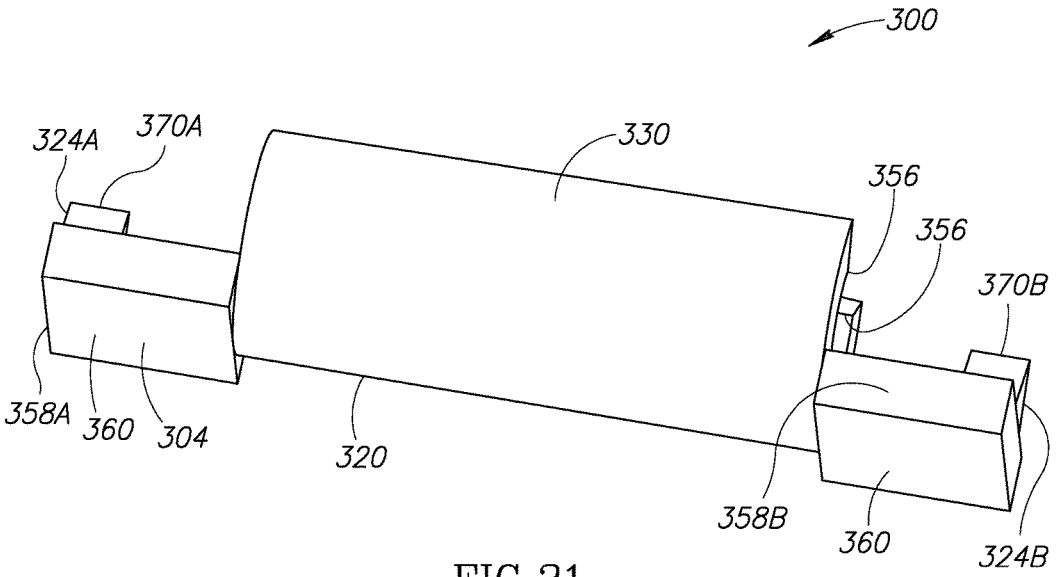
FIG. 31 is a perspective view of an underside of the wire connector of FIG. 28.

FIG. 31 is a perspective view of an underside 304 of the wire connector 300 opposite the wire receiving side of the wire connector 300. The wire connector 300 includes a frontwardly extending support 358A and a backwardly extending support 358B. The front tab 324A is positioned on and extends upwardly from the frontwardly extending support 358A. The back tab 324B is positioned on and extends upwardly from the backwardly extending support 358B. Each of the frontwardly and backwardly extending supports 358A and 358B includes a lower surface 360. The lower surfaces 360 may be mounted on (e.g., soldered to) a contact (e.g., one of the contacts 550A-550H depicted in FIG. 34).

Returning to FIG. 30, the tabs 324A and 324B are centered laterally with respect to the wire receptacle 334. In the embodiment illustrated, the tabs 324A and 324B are tapered, having pointed distal end portions 370A and 370B, respectively. The pointed distal end portions 370A and 370B are configured to pierce the insulating jacket "J-A" (see FIG. 28) of the wire "W-A" (see FIG. 28). Returning to FIG. 30, in the embodiment illustrated, the pointed distal end portions 370A and 370B may also pierce the conductor "C-A." However, this is not a requirement.

Returning to FIG. 29, the wire "W-A" may be placed adjacent the gap 332 with the free distal end 110 near the back tab 324B. Then, referring to FIG. 29, the wire body portion 112 (see FIG. 28) may be pressed into the wire receptacle 334 through the gap 332. When the wire "W-A" (see FIG. 28) is pressed through the gap 332, the sharp lower edge 356 of at least one of the distal edge portions 352 and 354 cuts through the insulating jacket "J-A" (and optionally cuts partially into the conductor "C-A") to form an electrical connection with the conductor "C-A." The electrical connection may be formed where the gap 332 is just wide enough to accommodate the conductor "C-A" and/or deform or cut into the conductor "C-A" to form a gas tight contact therewith.

Because the gap 332 is tapered, the wire connector 300 may be used to terminate wires having different diameters. Further, the wire "W-A" may not pass through the entire length of the gap 332. Instead, a portion of the wire "W-A" near the front tab 324A may rest upon the distal edge portions 352 and 354 of the sidewall 330 adjacent the gap 332. However, this is not a requirement.

The tabs 324A and 324B may help center the wire "W-A" with respect to the sharp lower edges 356 of the distal edge portions 352 and 354. Optionally, the tabs 324A and 324B may cut through the insulating jacket "J-A" (and optionally partially into the conductor "C-A") to form an electrical connection with the conductor "C-A." The tabs 324A and 324B may become at least partially embedded in the insulating jacket "J-A" to help prevent longitudinal movement of the wire "W-A" with respect to the wire connector 300. Thus, the tabs 324A and 324B may provide some strain relief. The tabs 324A and 324B may also help limit the inward movement of the wire "W-A" into the wire receptacle 334. Thus, the tabs 324A and 324B may limit the depth of the penetration of the wire "W-A."

The wire connector 300 may be surface-mounted (e.g., via a planar soldering process) to a PCB (e.g., a PCB 520 illustrated in FIG. 34). Alternatively, the wire connector 300 may include one or more contacts (not shown) each configured to be inserted into a plated through-hole (e.g., one of the plated through-holes 146 illustrated in FIG. 16). By way of a non-limiting example, a contact (not shown) may extend downwardly from the lower surface 360 of at least one of the frontwardly and backwardly extending supports 358A and 358B.

Fourth Embodiment

Figure 32:
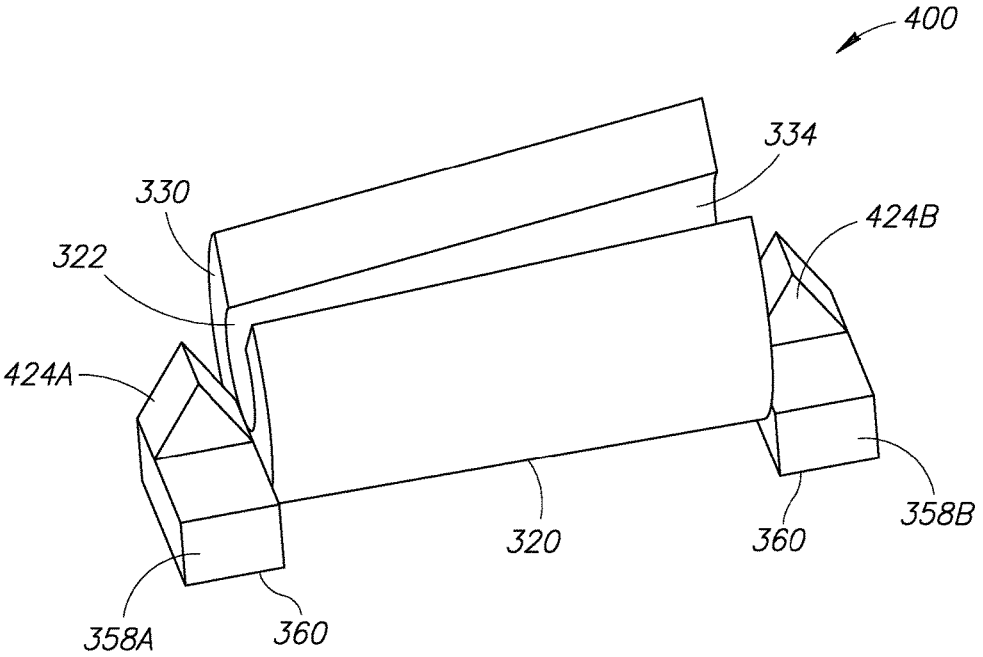
FIG. 32 is a perspective view of a fourth embodiment of a wire connector.

FIG. 32 is a perspective view of a fourth embodiment of a wire connector 400. The wire connector 400 may be used with the wire "W-A" depicted in FIGS. 13, 17, 19-21, 24, 25, and 28. The wire connector 400 may be constructed from any material suitable for constructing the wire connector 100 (see FIGS. 13-15). Identical reference numerals have been used in FIGS. 28-32 to identify like structures. The wire connector 400 omits the tabs 324A and 324B (see FIGS. 29-31). Instead, the wire connector 400 includes tabs 424A and 424B. Like the tabs 324A and 324B (see FIGS. 29-31), the tabs 424A and 424B are centered with respect to the wire receptacle 334. The tabs 424A and 424B may be formed by bending a portion of the frontwardly and backwardly extending supports 358A and 358B, respectively, upwardly. The wire connector 400 may be surface-mounted (e.g., via a planar soldering process) to a PCB (e.g., the PCB 520 depicted in FIG. 34). Alternatively, the wire connector 400 may include one or more contacts (not shown) each configured to be inserted into a plated through-hole (e.g., one of the plated through-holes 146 illustrated in FIG. 16). By way of a non-limiting example, a contact (not shown) may extend downwardly from the lower surface 360 of at least one of the frontwardly and backwardly extending supports 358A and 358B.

Fifth Embodiment

Figure 33:
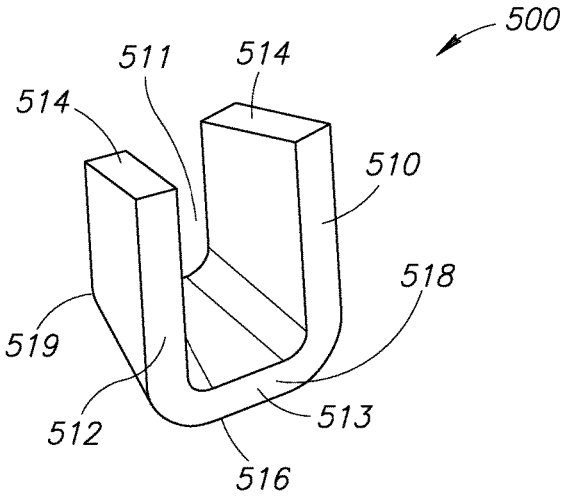
FIG. 33 is a perspective view of a fifth embodiment of a wire connector.

FIG. 33 is a perspective view of a fifth embodiment of a wire connector 500. The wire connector 500 may be constructed from any material suitable for constructing the wire connector 100 (see FIGS. 13-15). The wire connector 500 is generally U-shaped having a first arm 510 spaced apart from a second arm 512. The arms 510 and 512 are attached by a base portion 513.

Each of the arms 510 and 512 has tapered upper surface 514 configured to pierce the insulating jacket (e.g., the insulating jacket "J-A") of a wire (e.g., the wire "W-A") to make contact with an electrical conductor (e.g., the conductor "C-A"). The arms 510 and 512 are adequately spaced apart to receive the conductor "C-A" (see FIGS. 13 and 29) of the wire "W-A" therebetween with at least one of the arms 510 and 512 contacting the conductor "C-A."

The base portion 513 has a lower surface 516. The wire connector 500 may be surface-mounted by its lower surface 516 (e.g., via a planar soldering process) to a PCB (e.g., the PCB 520 illustrated in FIGS. 34 and 35). Alternatively, the wire connector 500 may include one or more contacts (not shown) each extending downwardly from the lower surface 516 and configured to be inserted into a plated through-hole (e.g., one of the plated through-holes 146 illustrated in FIG. 16).

The base portion 513 has a front portion 518 opposite a back portion 518. The arms 510 and 512 may be spaced apart by greater distance at the front portion 518 of the base portion 513 than at the back portion 519. Thus, a tapered opening 511 is defined between the arms 510 and 512 into which the conductor "C-A" of the wire "W-A" may be received.

FIG. 34 is a perspective view of eight wire connectors 500A-500H mounted on the PCB 520. Each of the wire connectors 500A-500H is substantially identical to the wire connector 500. In FIG. 34, the wire connectors 500A-500H are surface mounted to the contacts 550A-550H, respectively.

Figure 35:
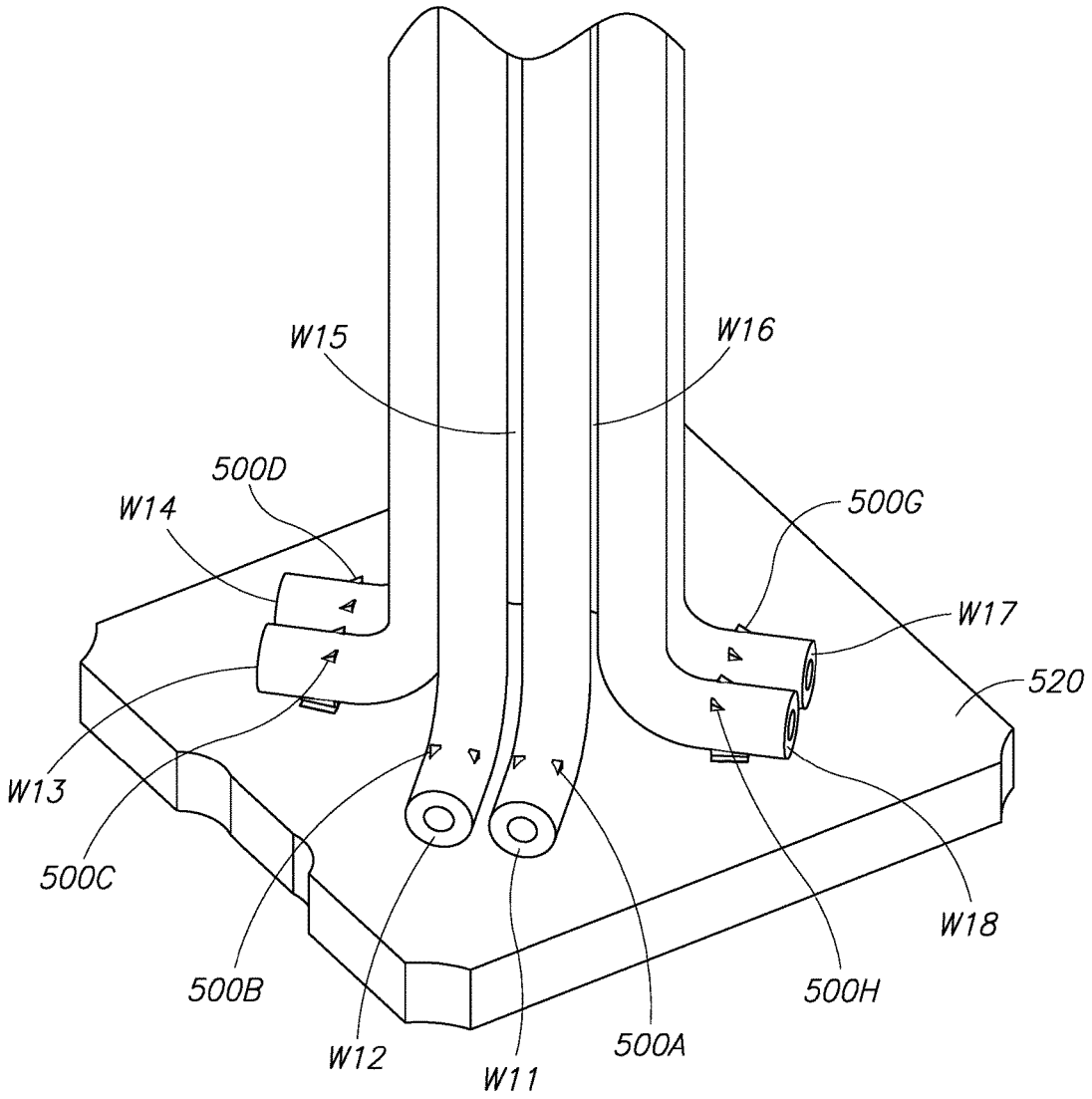
FIG. 35 is a perspective view of eight wires terminated at the wire connectors of FIG. 34.

FIG. 35 is a perspective view of wires W11-W18 terminated at the wire connectors 500A-500H, respectively, mounted on the PCB 520. The wires W11-W18 may be components of a cable (not shown). Each of the wires W11-W18 is substantially identical to the wire "W-A" (see FIGS. 13, 17, 19-21, 24, 25, and 28). The wire connectors 500A-500H pierce the insulating jackets of the wires W11-W18, respectively, and form electrical connections with the conductors of the wires W11-W18, respectively. Returning to FIG. 34, each of the contacts 550A-550H is connected to one or more electrical circuits (not shown) on the PCB 520. Thus, the wire connectors 500A-500H form electrical connections between the wires W11-W18 and the one or more circuits (not shown) on the PCB 520. By way of a non-limiting example, the contacts 550A-550H may be implemented as conventional contact pads.

The embodiments depicted in FIGS. 13-17, 19-21, and 24-37 and described above may be modified to include additional features, such as additional pierce points, rough or toothed edges, slots or tabs configured to enhance wire retention in one or more axes and/or to compartmentalize and/or localize the crimping operation. Further, the embodiments depicted in FIGS. 13-17, 19-21, and 24-37 and described above may be modified to include tines, teeth, contacts, flexible contacts, soldertails, and/or mechanical retention features, such as partial transverse slits (or channels) configured to allow independent collapse of a portion of the body portion during the crimping operation.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A shield for use with a cable comprising a cable jacket surrounding a plurality of wire pairs, and a different pair shield surrounding each wire pair, end portions of the wire pairs extending outwardly from the cable jacket, the shield comprising one or more compressible members positioned adjacent the end portions of at least a portion of the wire pairs, the one or more compressible members being configured to press one or more conductive members against the pair shield surrounding each wire pair in the portion of wire pairs.

2. The shield of claim 1, further comprising:

a housing configured to compress the one or more compressible members.

3. A shield for use with a cable comprising a plurality of wire pairs, and a different pair shield surrounding each pair, the shield comprising:

a compressible body portion having a plurality of open-ended channels formed therein, the plurality of channels comprising a different corresponding channel for each of at least a portion of the wire pairs, each of the channels being configured to house both the wire pair corresponding to the channel and the pair shield surrounding the wire pair; and at least one conductive portion positioned inside at least a portion of the channels, when both the wire pair corresponding to each channel in the portion of channels and the pair shield surrounding the wire pair are housed inside the corresponding channel, the compressible body portion being sufficiently compressible to press the at least one conductive portion into contact with the pair shield surrounding the wire pair housed inside each of the channels in the portion of channels.

4. The shield of claim 3 for use with the plurality of wire pairs comprising a first, second, third, and fourth wire pair, wherein the plurality of open-ended channels comprises a first, second, third, and fourth channels, the first, second, third, and fourth channels correspond to the first, second, third, and fourth wire pairs, respectively, the at least one conductive portion comprises a first conductive portion, and a second conductive portion, the first conductive portion is positioned inside the second and third channels, and the second conductive portion is positioned inside the first and fourth channels.

5. The shield of claim 4, wherein the first and second conductive portions are constructed from a metal foil, or a plastic film with a conductive coating.

6. The shield of claim 4, wherein the compressible body portion is constructed from foam.

7. The shield of claim 3, further comprising a housing configured to sufficiently compress the compressible body portion to press the at least one conductive portion into contact with the pair shield surrounding the wire pair housed inside each of the channels in the portion of channels.

8. A connection comprising:

a cable comprising a cable jacket surrounding a plurality of wire pairs, and a different pair shield surrounding each wire pair, end portions of the wire pairs and an end portion of the pair shield surrounding each wire pair extending outwardly from the cable jacket;

a communications connector configured to be coupled to the end portions of each of the plurality of wire pairs; and a shield assembly having a first conductive portion configured to contact the end portion of the pair shield surrounding each of a first portion of the wire pairs.

9. The connection of claim 8, wherein the shield assembly comprises a body portion having a different channel for each of the first portion of wire pairs, the channel housing both the end portion of the wire pair and the end portion of the pair shield surrounding the wire pair.

10. The connection of claim 9, wherein a portion of the conductive portion extends inside each different channel and contacts the end portion of the pair shield housed therein.

11. The connection of claim 10, wherein the end portion of the pair shield housed inside each different channel terminates inside the channel and does not exit therefrom.

12. The connection of claim 8, wherein the shield assembly is slidable with respect to the end portions of the first portion of wire pairs.

13. The connection of claim 8, wherein the shield assembly has a second conductive portion configured to contact the end portion of the pair shield surrounding each of a different second portion of the wire pairs.

14. The connection of claim 8, wherein the shield assembly is positioned between an end of the cable jacket and the communications connector.

15. The connection of claim 8, wherein the shield assembly further comprises a housing and a compressible portion adjacent the first conductive portion, the housing being configured to sufficiently compress the compressible portion to press the first conductive portion into contact with the end portion of the pair shield surrounding each of the first portion of the wire pairs.

* * * * *